US012415590B2

(12) United States Patent
Curtin et al.

(10) Patent No.: US 12,415,590 B2
(45) Date of Patent: Sep. 16, 2025

(54) FOLDABLE FIN FOR WATERSPORT EQUIPMENT

(71) Applicant: HO SPORTS COMPANY, LLC, Snoqualmie, WA (US)

(72) Inventors: Thomas M. Curtin, Snoqualmie, WA (US); Gregg A. Vukelic, Issaquah, WA (US); Scott M. Stephan, Seattle, WA (US)

(73) Assignee: HO SPORTS COMPANY, LLC, Snoqualmie, WA (US)

( * ) Notice: Subject to any disclaimer, the term of this patent is extended or adjusted under 35 U.S.C. 154(b) by 473 days.

(21) Appl. No.: 18/074,441

(22) Filed: Dec. 2, 2022

(65) Prior Publication Data

US 2023/0174200 A1 Jun. 8, 2023

Related U.S. Application Data

(60) Provisional application No. 63/285,941, filed on Dec. 3, 2021.

(51) Int. Cl.
*B63B 32/64* (2020.01)
*B63B 32/66* (2020.01)

(52) U.S. Cl.
CPC ..... *B63B 32/64* (2020.02); *B63B 32/66* (2020.02)

(58) Field of Classification Search
CPC ..... B63B 32/64; B63B 32/66
See application file for complete search history.

(56) References Cited

U.S. PATENT DOCUMENTS

| | | | | |
|---|---|---|---|---|
| 5,664,979 | A * | 9/1997 | Benham | B63B 32/64 114/140 |
| 5,813,890 | A * | 9/1998 | Benham | B63B 32/66 114/140 |
| D428,459 | S * | 7/2000 | Broz | D21/769 |
| 6,244,921 | B1 * | 6/2001 | Pope | B63B 32/66 114/130 |
| 8,408,958 | B2 * | 4/2013 | Benham | B63B 32/66 441/74 |
| 9,139,265 | B2 * | 9/2015 | Peberdy | B63B 32/64 |
| 9,487,276 | B1 * | 11/2016 | Kusch | B63B 32/66 |
| 9,896,168 | B1 * | 2/2018 | Lindbergh | B63B 32/66 |
| 9,944,363 | B2 * | 4/2018 | Venables | G05D 1/0875 |

(Continued)

FOREIGN PATENT DOCUMENTS

| | | | | |
|---|---|---|---|---|
| CN | 104260844 A * | 1/2015 | | |
| WO | WO-2015135034 A1 * | 9/2015 | | B63B 32/66 |

OTHER PUBLICATIONS

Kaetano (CN 104260844) Machine Translation (Year: 2015).*

*Primary Examiner* — Brian Christopher Delrue
(74) *Attorney, Agent, or Firm* — BakerHostetler

(57) ABSTRACT

The present technology is generally directed to a fin assembly for watersport equipment, a watersport system including thereof, and a method of using thereof. In various embodiments, the fin assembly includes a support base and a foldable fin. The support base may be configured to attach the fin assembly to a surface of the watersport equipment. The foldable fin may include a fin portion configured to move between a folded position and a use position. The support base may have a locking member configured to lock the fin portion in and release the fin portion from the use position.

20 Claims, 18 Drawing Sheets

(56) References Cited

U.S. PATENT DOCUMENTS

| | | | | |
|---|---|---|---|---|
| 11,661,155 | B2 * | 5/2023 | Khaladj | B63B 32/66<br>441/79 |
| 2004/0043681 | A1 * | 3/2004 | Jolly | B63B 32/66<br>441/79 |
| 2010/0323568 | A1 * | 12/2010 | Chambers | B63B 32/66<br>441/79 |
| 2013/0183152 | A1 * | 7/2013 | Peberdy | B63B 39/06<br>416/9 |
| 2017/0096199 | A1 * | 4/2017 | Hall | B63B 32/66 |

* cited by examiner

FOLDABLE FIN FOR WATERSPORT EQUIPMENT

CROSS-REFERENCE TO RELATED APPLICATION(S)

The present application claims the benefit of U.S. Provisional Patent Application No. 63/285,941, filed Dec. 3, 2021, which is incorporated herein by reference in its entirety.

TECHNICAL FIELD

The present technology is directed generally to fins or skegs for watersport boards, such as paddle boards, kayaks, wakeboards, surfboards, and water skis, and other types of boards used in water sports, and more particularly to a fin that is not rigidly attached to the watersport board.

BACKGROUND

Watersport boards typically include a downwardly projecting fin situated on the rear bottom of the board that is used to aid steering and stability. However, when the user wishes to transport or store the board, the projecting fin makes doing so more difficult and requires more space. Stacking of boards is difficult or impossible, and the protruding fin can present a hazard. In the case of inflatable watersport boards, rolling and packing of the deflated board is difficult and often requires use of a fin that is shorter than desirable. In addition, the projecting fin can present a hazard when the board is not in the water.

The fin is typically fixedly attached to the watersport board, though some designs provide for complete removal of a fin from the board. Once disconnected and separated from the board, the removable fin may be easily lost, damaged, and/or the user may forget to take the removed fin along on the next trip when the board is intended to be used. Further, the removable fin has a risk of falling off in the water during use of the board. Also, reattaching the fin to the board may take more time and effort than desirable.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present disclosure.

Like reference numerals have been used in the figures to identify like components.

DETAILED DESCRIPTION

Folding fins for water sports and associated systems and methods are disclosed herein. The folding fins disclosed herein can be fixedly attached to various types of watersport equipment, such as paddle boards, kayaks, wakeboards, surfboards, and water skis, and/or other types of sporting equipment that typically includes a fin. Specific details of several embodiments of the present technology are described herein with reference to FIGS. 1-33B. The present technology, however, can be practiced without some of these specific details. In some instances, well-known structures and techniques often associated watersport boards, and the like, have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms can even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements can be arbitrarily enlarged to improve legibility. Component details can be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology.

Figure 1:
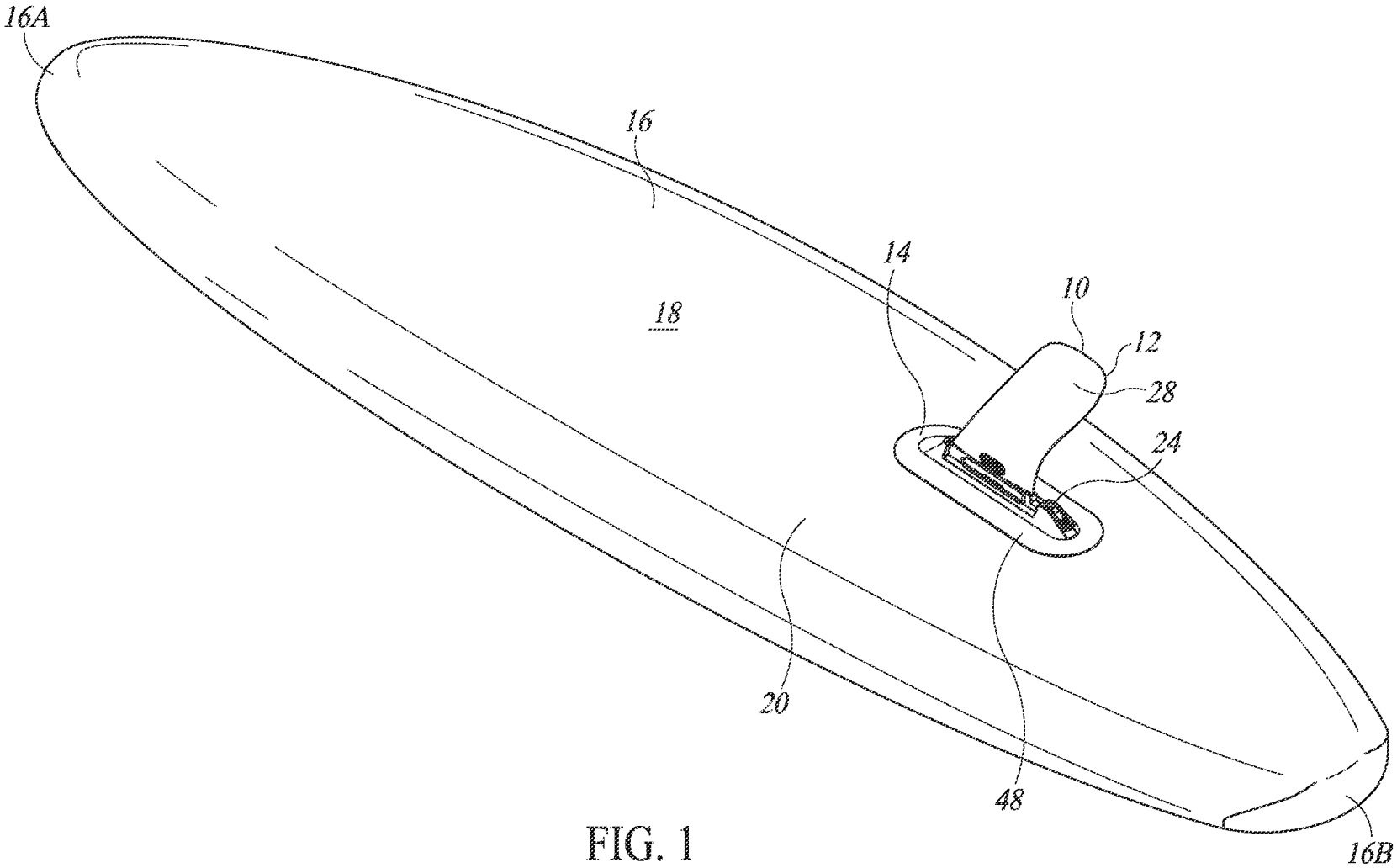
FIG. 1 is a perspective view of a fin assembly with a support base attached to a bottom side of a watersport board configured in accordance with embodiments of the present technology.
Figure 2:
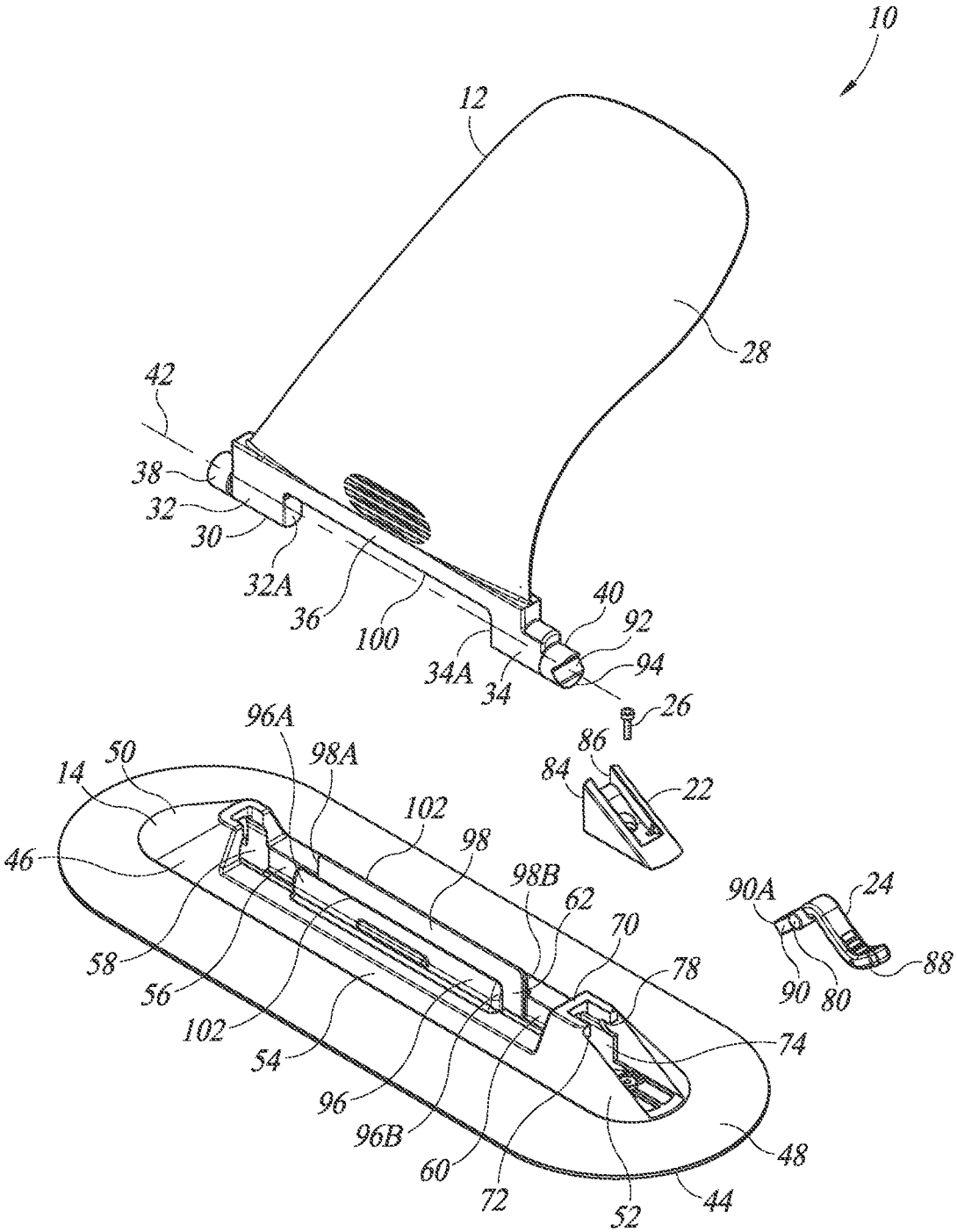
FIG. 2 is an exploded view of the fin assembly of FIG. 1.
Figure 3:
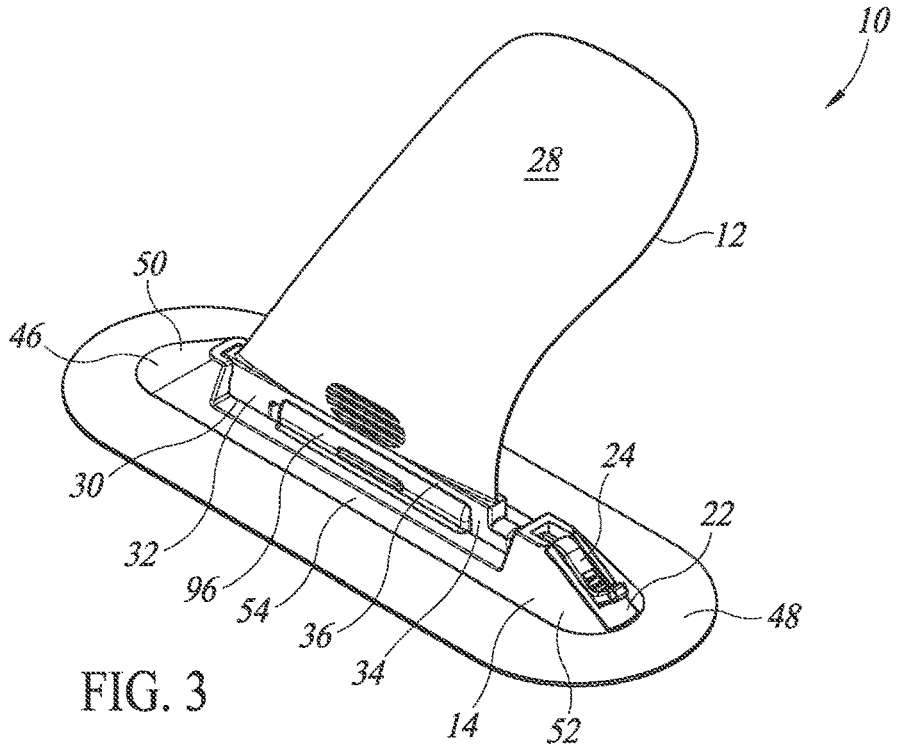
FIG. 3 is a side perspective view of the fin assembly of FIG. 1 with a foldable fin locked in a use position by a locking member in accordance with embodiments of the present technology.
Figure 4:
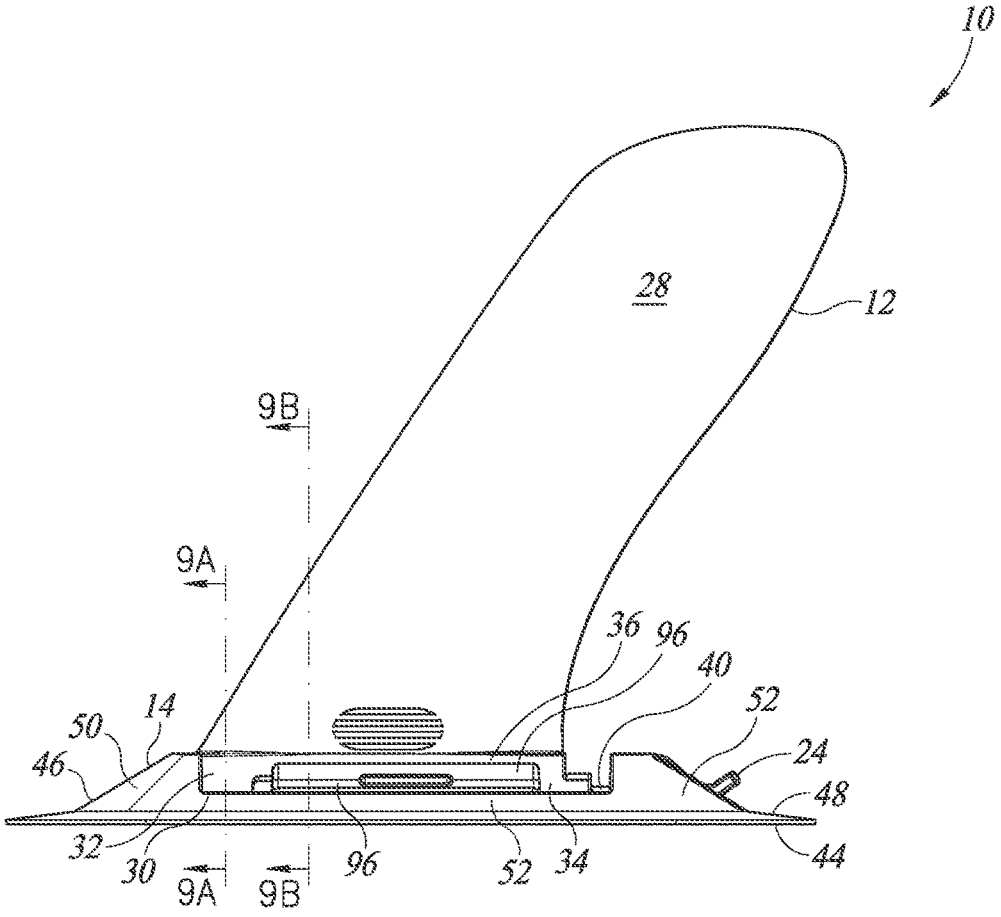
FIG. 4 is a side elevational view of the fin assembly of FIG. 3.
Figure 5:
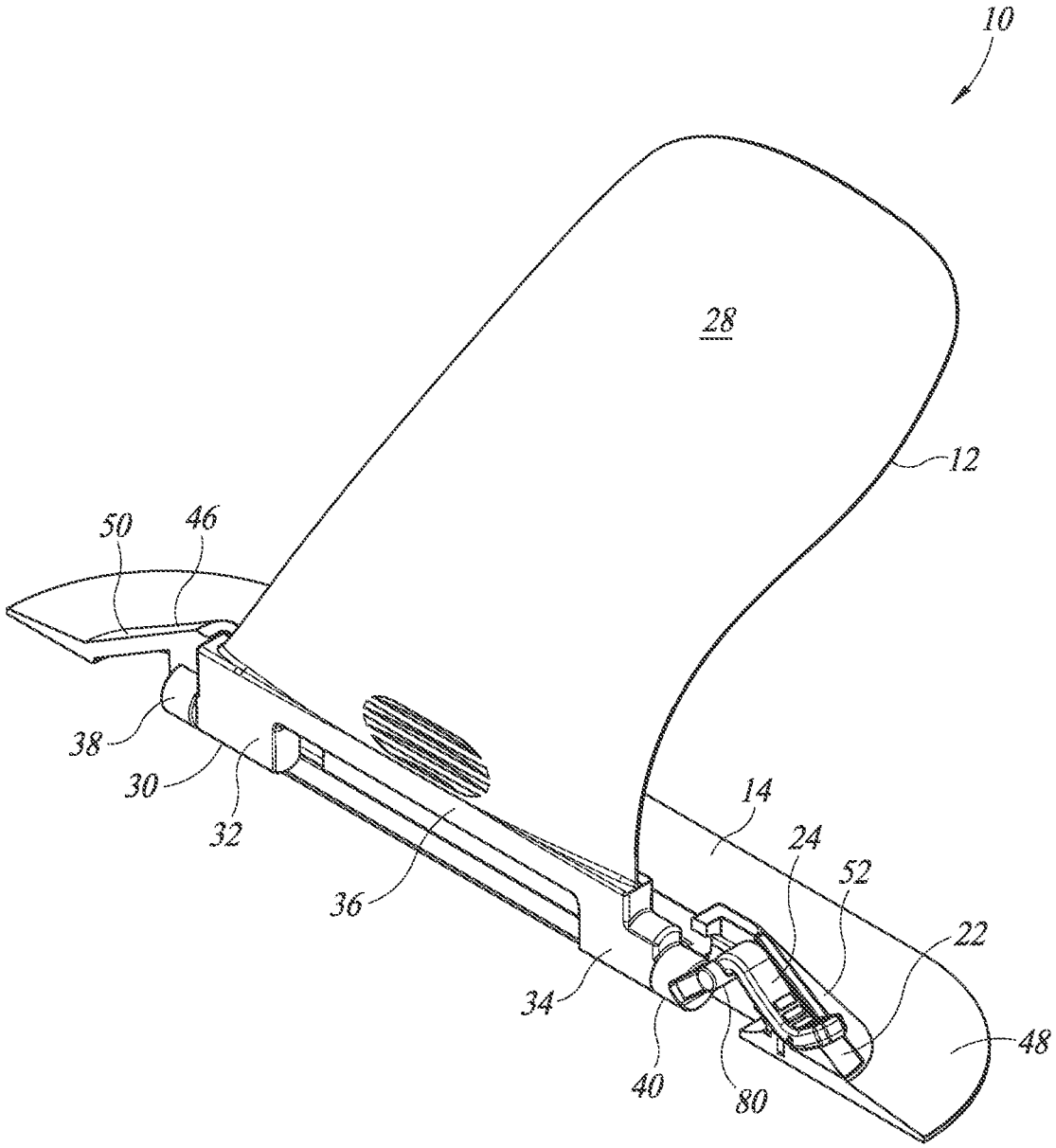
FIG. 5 is a perspective, partial cross-sectional side view of the fin assembly of FIG. 3.

FIG. 1 is a perspective view of a fin assembly 10 in a use position in accordance with embodiments of the present technology, and FIG. 2 is an exploded view of the fin assembly 10 of FIG. 1. The fin assembly 10 includes a foldable fin 12 and a support base 14 (also referred to as a "fin box") that can be permanently or removably attached to a watersport board 16 having a forward end 16A and a rearward end 16B. The support base 14 is shown attached to a bottom side 18 of the watersport board 16 at a rearward end portion 20 of the watersport board 16. While the support base 14 is illustrated as attached to the surface of the watersport board 16, the support base 14 may be positioned within a recess (not shown) and/or opening in the bottom side 18 of the watersport board 16.

Referring to FIG. 2, the fin assembly 10 can include a positioning retainer member 22 (also referred to as a "wedge"), a locking lever or member 24, and a fastener 26, which together form part of the support base 14. The fastener 26 may be a screw or other type fastener 26. The foldable fin 12 has a fin portion 28 rigidly attached to a fin base portion 30 and projecting away from the fin base portion 30. When the fully assembled fin assembly 10 is attached to the watersport board 16 and the foldable fin 12 is in a use position, as shown in FIG. 1, the fin portion 28 projects away from (e.g., being substantially perpendicular to) the bottom side 18 of the watersport board 16. The fin assembly 10 is also shown in the use position in FIGS. 3-9B.

As shown in FIG. 2, the fin base portion 30 has a forward end base portion 32 and a rearward end base portion 34, with a middle portion 36 located between the forward and rearward end base portions 32 and 34. The fin base portion 30 further includes a cylindrical forward bolt or pivot member 38 projecting forward from the forward end base portion 32 of the fin base portion 30, and a rearward bolt or pivot member 40 projecting rearward from the rearward end base portion 34 of the fin base portion 30. The forward and rearward pivot members 38 and 40 are in axial alignment with a central axis of rotation 42 for the fin assembly 10.

As further shown in FIG. 2, the support base 14 has a mounting side portion 44 in contact with the bottom side 18 of the watersport board 16 when attached thereto, and an outward projecting portion 46 projecting away from the bottom side 18 of the watersport board 16 and having an outward perimeter wall portion 48 extending fully about the outward projecting portion 46. As viewed in the drawings, the outward projecting portion 46 projects upward, although when the watersport board 16 is in use in water, the outward projecting portion 46 projects downward into the water.

The outward projecting portion 46 of the support base 14 has a forward end portion 50 and a rearward end portion 52, with a middle portion 54 extending therebetween. The outward projecting portion 46 further includes a channel 56 (also referred to as an "elongated slot") extending along a longitudinal axis of the support base 14 between and within the forward end portion 50 and the rearward end portion 52, and along the middle portion 54, of the outward projecting portion 46. The channel 56 faces away from the mounting side portion 44 of the support base 14, and also away from the bottom side 18 of the watersport board 16. The channel 56 includes a forward channel portion 58 sized to receive the forward pivot member 38 of the fin base portion 30, and a rearward channel portion 60 sized to receive the rearward pivot member 40 of the fin base portion 30, with a middle channel portion 62 located and extending between the forward and rearward channel portions 58 and 60. The channel 56 has a bottom wall 56A running its full length. The fin assembly 10 is shown fully assembled with the forward pivot member 38 in the forward channel portion 58 and the rearward pivot member 40 in the rearward channel portion 60, with the fin portion 28 in the use position in FIGS. 3-9B. With the orientation shown in the drawings, the channel 56 is upwardly opening except at its forward and rearward end portions 50 and 52, as will be described below.

Figure 6:
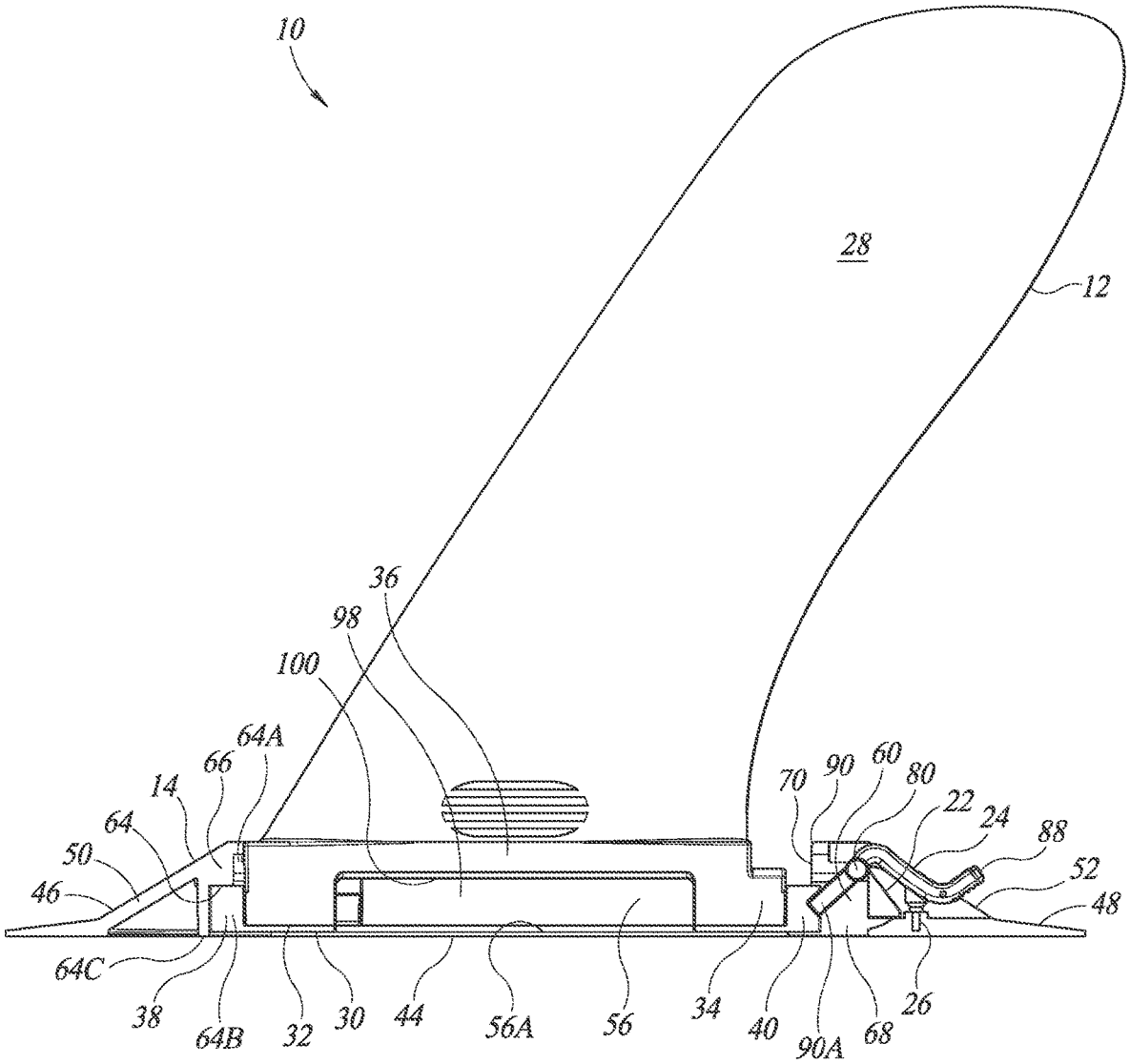
FIG. 6 is a side elevational, partial cross-sectional view of the fin assembly of FIG. 3.
Figure 7:
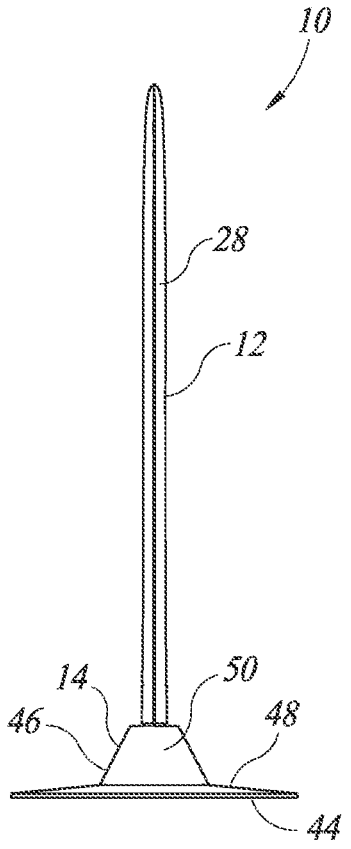
FIG. 7 is a front elevational view of the fin assembly of FIG. 3.
Figure 8:
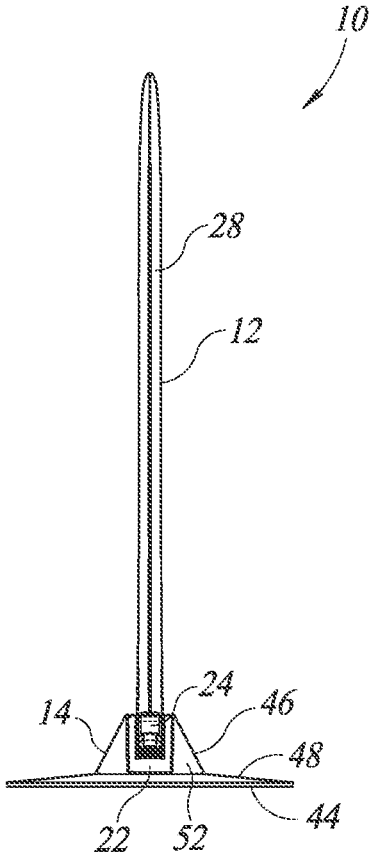
FIG. 8 is a rear elevational view of the fin assembly of FIG. 3.
Figure 10A:
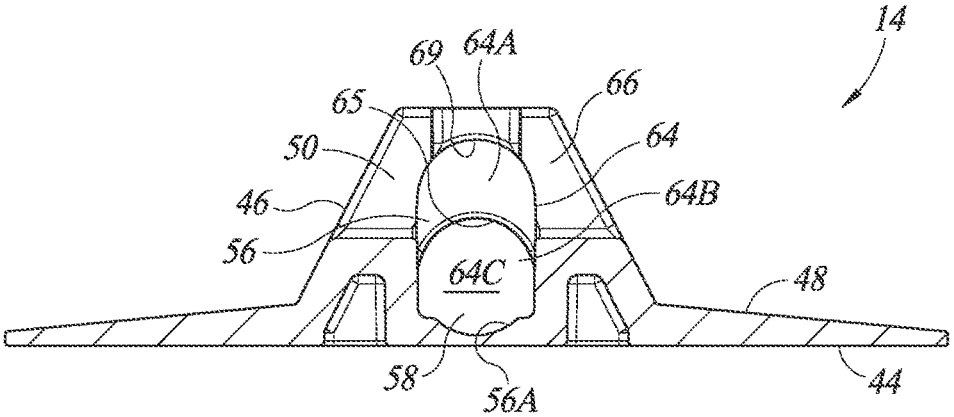
FIG. 10A is a cross-sectional view taken substantially along the line 10A-10A of FIG. 10.

Referring to FIG. 6 and FIG. 10A, the forward end portion of the forward channel portion 58 includes a forward recess 64 with a rearward opening in a rearward facing wall 66 of the forward end portion 50 of the outward projecting portion 46. The forward recess 64 includes an inward recess portion 64A and an outward recess portion 64B positioned forward of the inward recess portion 64A. When the fin portion 28 is in the use position, the forward pivot member 38 is positioned in the forward channel portion 58 and projects through the inward recess portion 64A and into the outward recess portion 64B, with the forward end of the forward pivot member 38 in engagement with a forward wall 64C of the outward recess portion 64B to limit forward movement of the forward pivot member 38 within the forward channel portion 58 during use of the watersport board 16. The outward recess portion 64B can have a partial cylindrical shape sized to snugly hold the forward pivot member 38 to limit its left and right movement and a wall portion 65 limiting movement of the forward pivot member 38 away from the support base 14 during use of the watersport board 16. When so positioned in the outward recess portion 64B, the forward pivot member 38 is held adjacent to the bottom wall 56A of the channel 56.

Figure 10B:
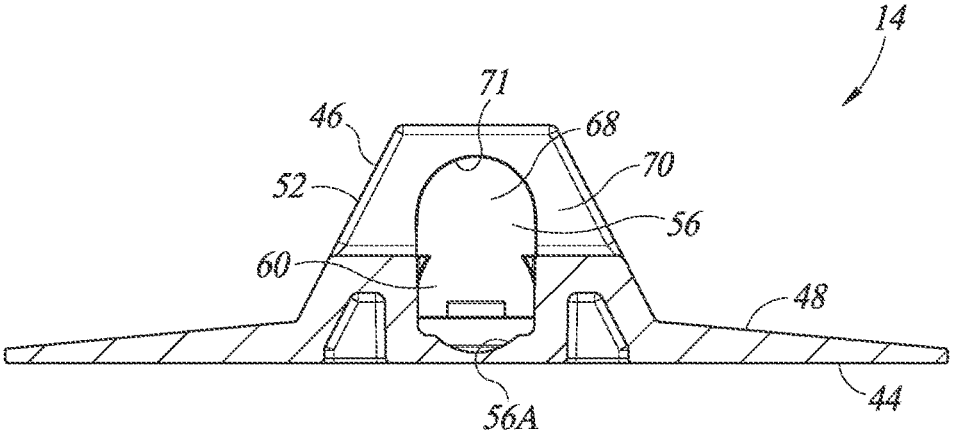
FIG. 10B is a cross-sectional view taken substantially along the line 10B-10B of FIG. 10.
Figure 10C:
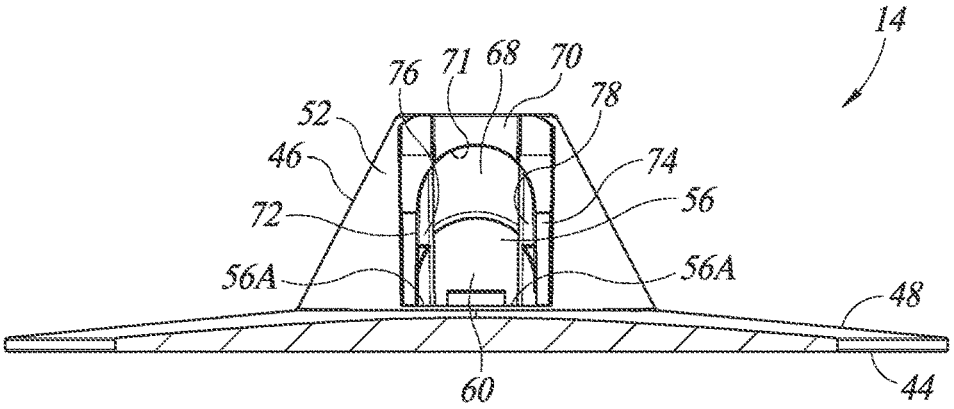
FIG. 10C is a cross-sectional view taken substantially along the line 10C-10C of FIG. 10.
Figure 12:
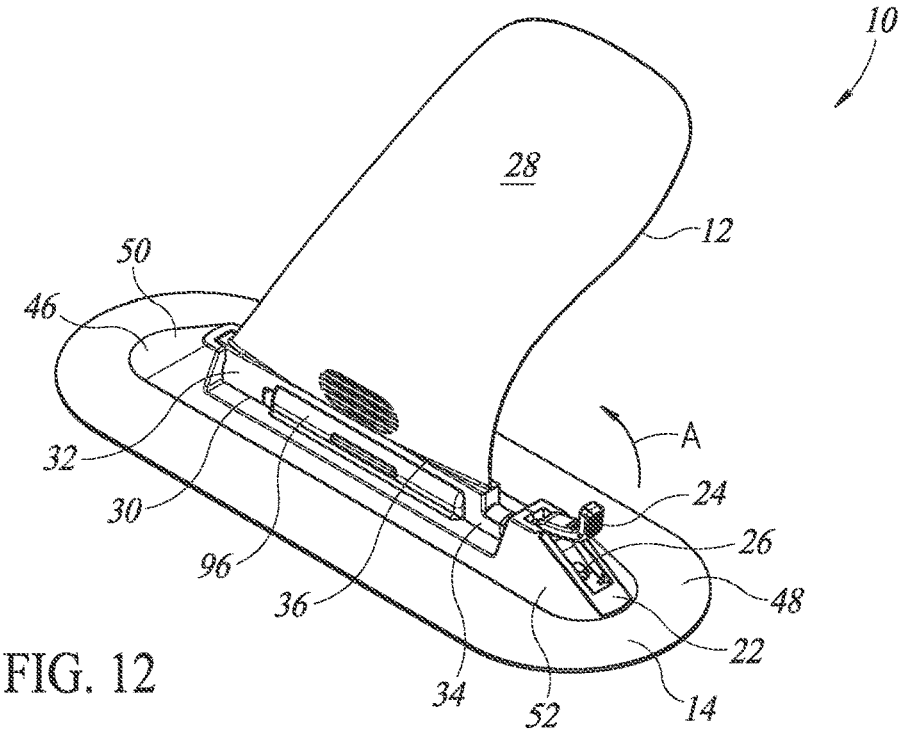
FIG. 12 is a side perspective view of the fin assembly of FIG. 1 with the locking member rotated in a direction "A" to an unlocked position in accordance with embodiments of the present technology.
Figure 13:
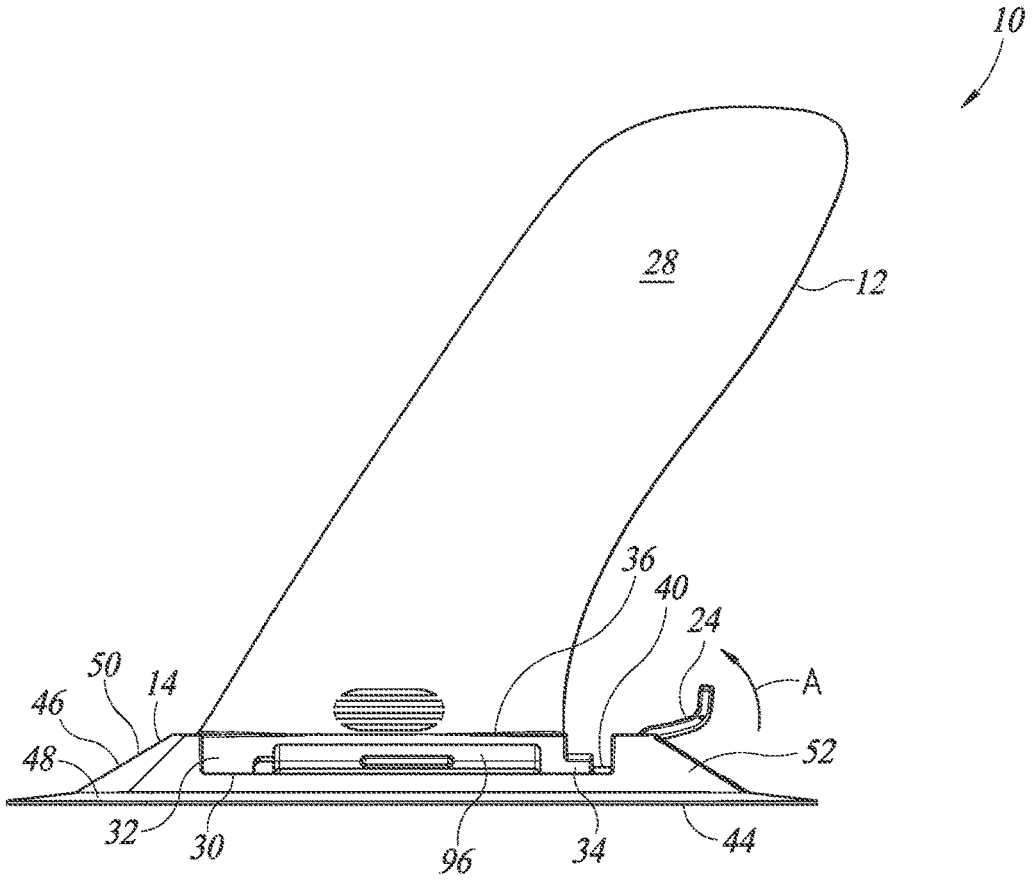
FIG. 13 is a side elevational view of the fin assembly of FIG. 12.
Figure 14:
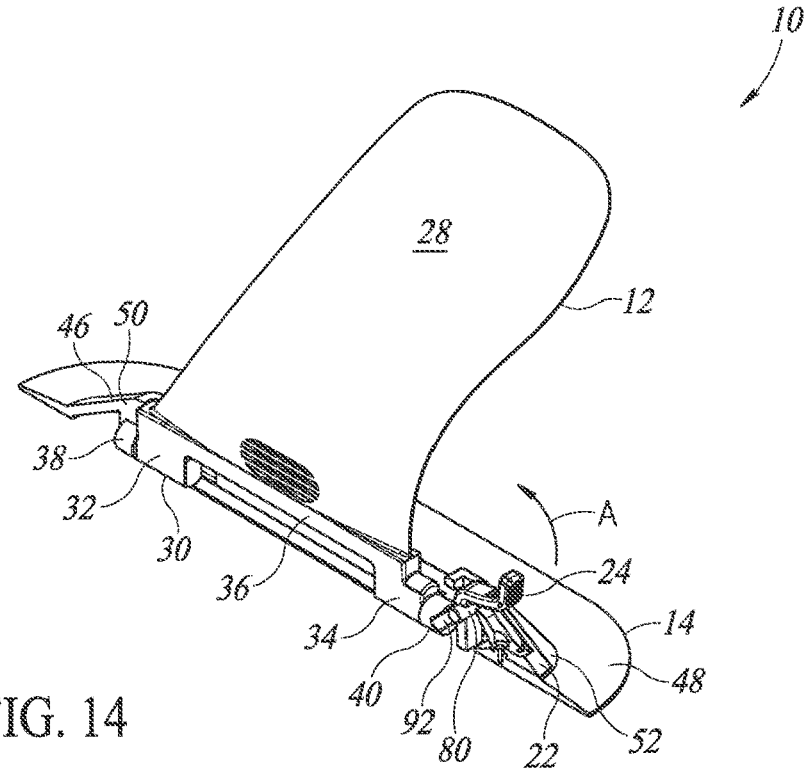
FIG. 14 is a perspective, partial cross-sectional view of the fin assembly of FIG. 12.

As shown in FIGS. 6 and 10B, the rearward end portion of the rearward channel portion 60 includes a rearward recess 68 with a forward opening in a forward facing wall 70 of the rearward end portion 52 of the outward projecting portion 46. When the fin portion 28 is in the use position, the rearward pivot member 40 is positioned in the rearward channel portion 60 and projects through the rearward recess 68. When so positioned in the rearward recess 68, the rearward pivot member 38 is held adjacent to the bottom wall 56A of the channel 56 by the locking member 24, as will be described below.

Figure 11:
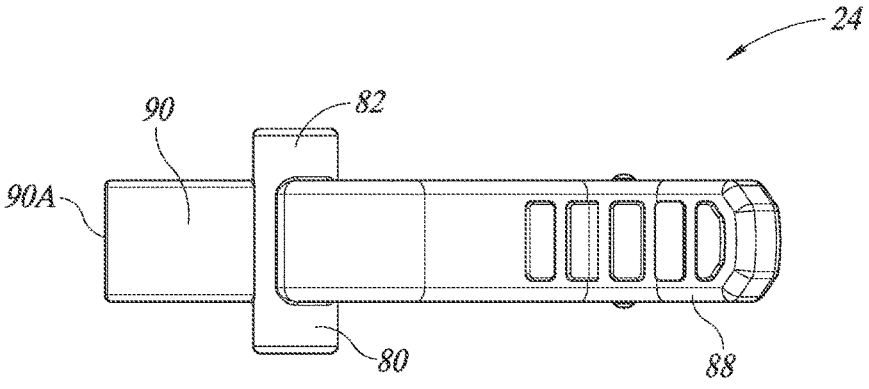
FIG. 11 is a plan view of a locking member of the fin assembly of FIG. 1.

Referring to FIGS. 2-10C, left and right lateral wall portions 72 and 74 of the rearward recess 68 extending rearward of the forward facing wall 70, each have a notch 76 and 78, respectively, therein with a rearward open end, the notches 76 and 78 being sized to rotatably retain a corresponding one of left and right pivot pins 80 and 82, respectively, of the locking member 24 (see FIGS. 2 and 11). The retainer member 22 is positioned in the rearward channel portion 60 within the rearward recess 68 and is removably held in position therein by the fastener 26 (see the left side elevational, cross-sectional view of FIG. 6). Left and right forward edge walls 84 and 86 of the retainer member 22 are positioned to block the rearward open ends of the notches 76 and 78, respectively, to retain the left and right pivot pins 80 and 82 in the notches 76 and 78.

Figure 15:
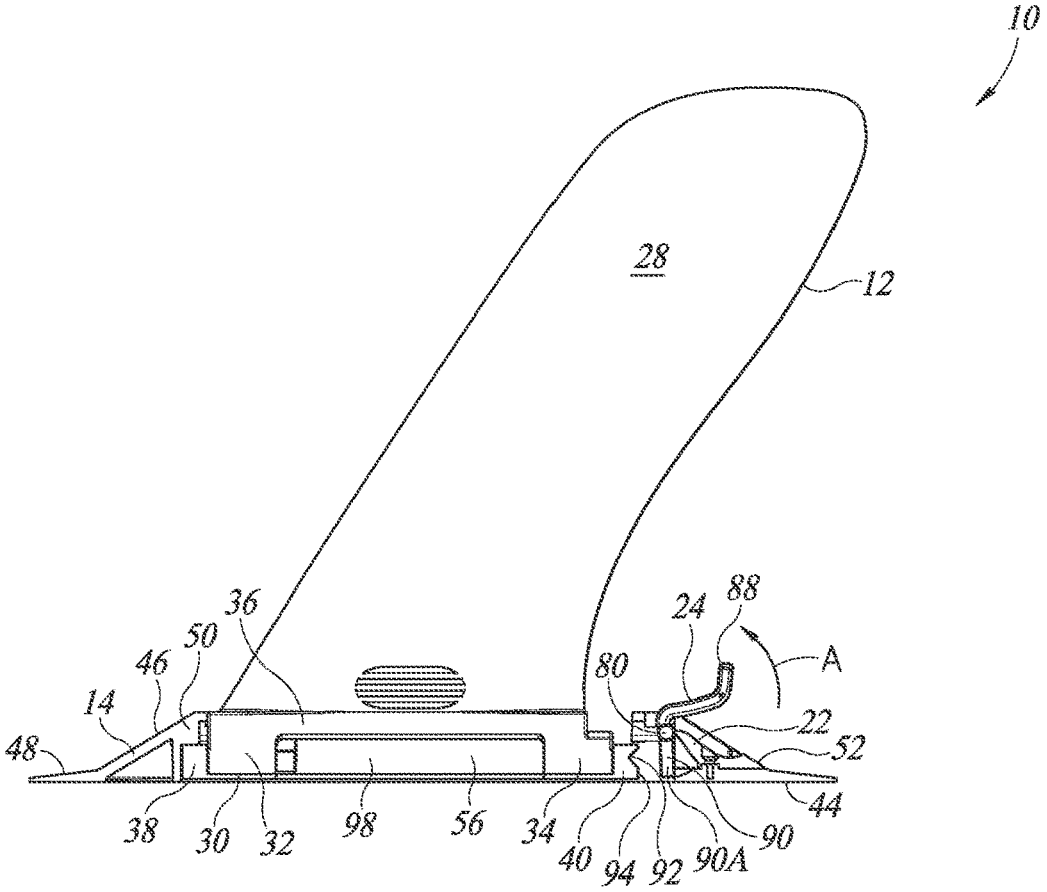
FIG. 15 is a side elevational, partial cross-sectional view of the fin assembly of FIG. 12.
Figure 16:
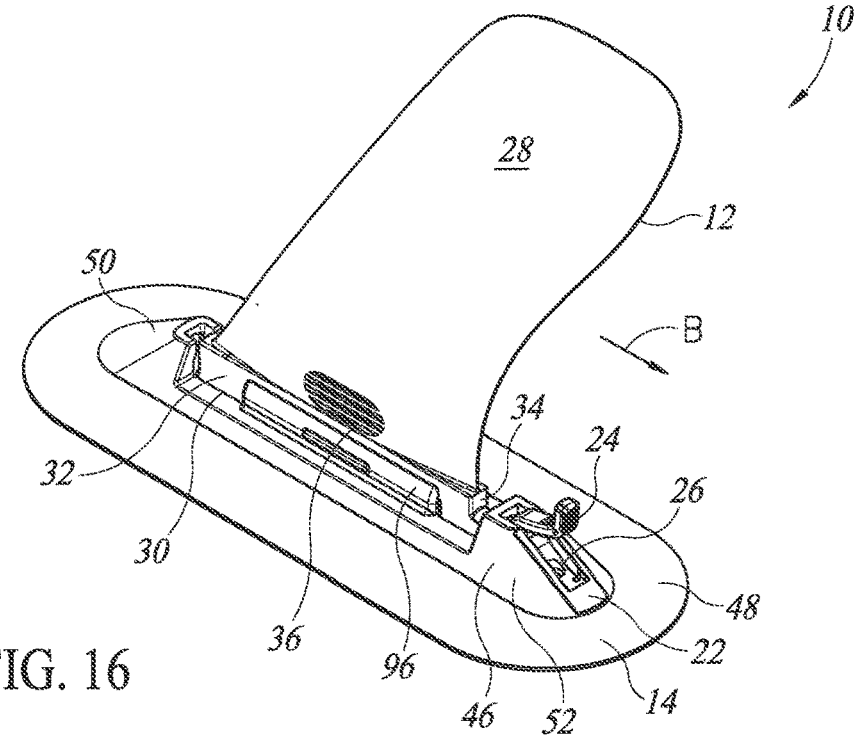
FIG. 16 is a side perspective view of the fin assembly of FIG. 12 with the foldable fin moved in a direction "B" relative to the support base in accordance with embodiments of the present technology.
Figure 17:
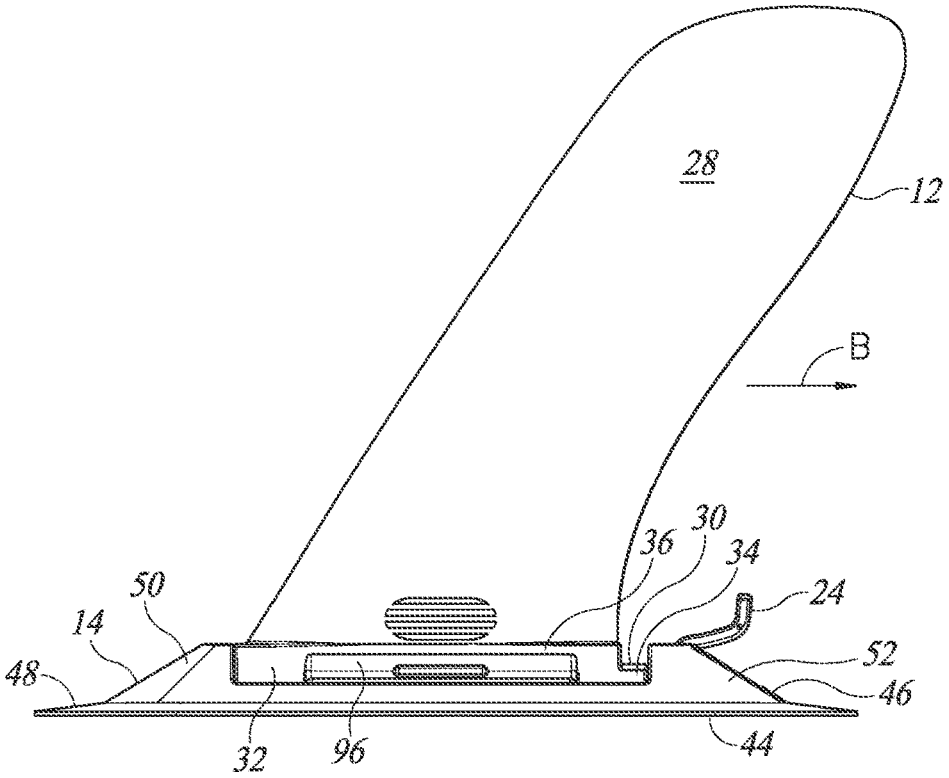
FIG. 17 is a side elevational view of the fin assembly of FIG. 16.
Figure 18:
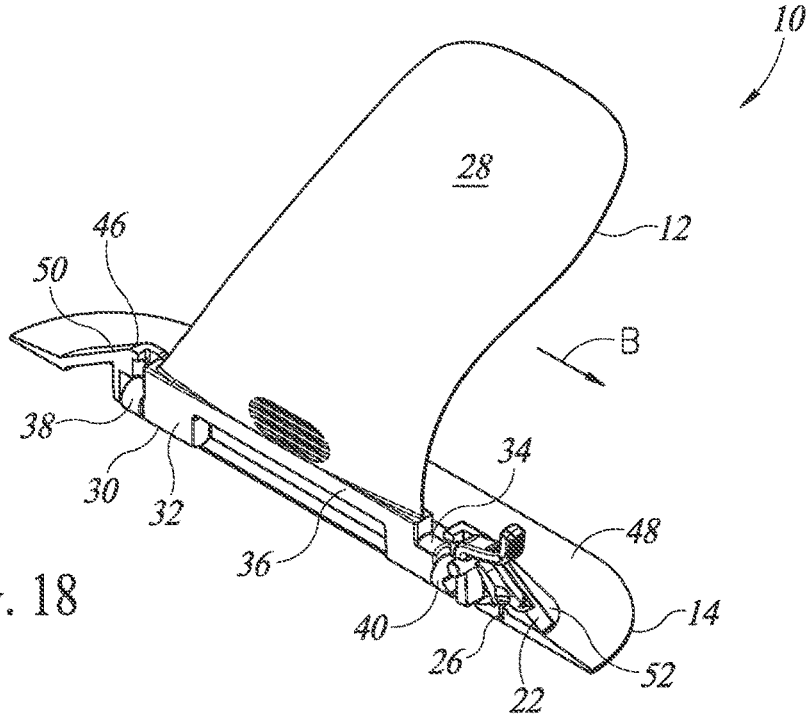
FIG. 18 is a perspective, partial cross-sectional view of the fin assembly of FIG. 16.

Referring to FIGS. 2, 11 and 15, the locking member 24 includes a rearward end portion 88 for gripping/pressing by a user to selectively rotate the locking member 24 about an axis of rotation of the left and right pivot pins 80 and 82 in clockwise and counterclockwise directions relative to the rearward channel portion 60, as viewed in the drawings, and a forward end portion 90 that moves in the same rotational direction as the rearward end portion 88 is moved. A rearward opening, laterally extending notch or groove 92 is provided in a rearward end face 94 of the rearward pivot member 40. In FIG. 6, the rearward end portion 88 of the locking member 24 has been rotated clockwise to position a forward end 90A of the forward end portion 90 of the locking member 24 in a locked position within the groove 92 of the rearward end face 94 of the rearward pivot member 40. In this position, the forward end portion 90 of the locking member 24 inhibits rearward movement of the rearward pivot member 40 and movement of the rearward pivot member 40 away from the support base 14 during use of the watersport board 16. The left and right lateral wall portions 72 and 74 of the rearward recess 68 limit left and right movement of the rearward pivot member 40 during use of the watersport board 16.

Figure 9A:
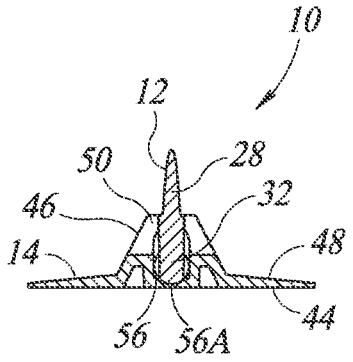
FIG. 9A is a cross-sectional view taken substantially along the line 9A-9A of FIG. 4.
Figure 9B:
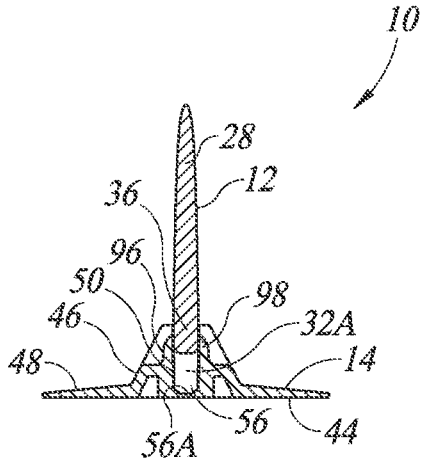
FIG. 9B is a cross-sectional view taken substantially along the line 9B-9B of FIG. 4.
Figure 10:
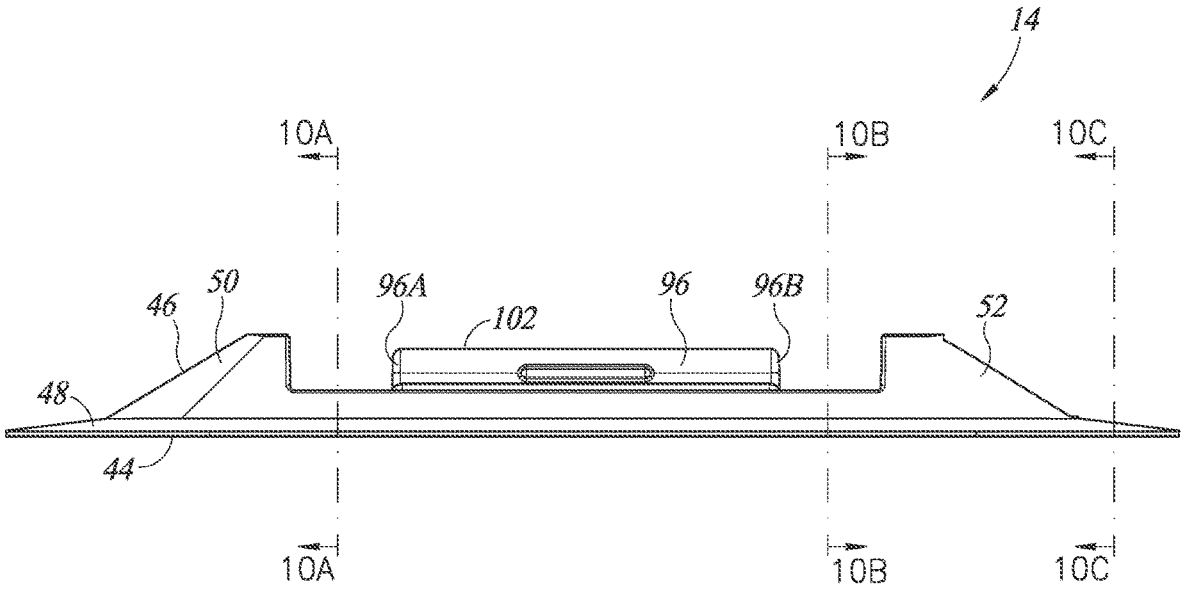
FIG. 10 is a side elevational view of a support base of the fin assembly of FIG. 1.

As shown in FIGS. 2 and 9B, outward projecting portion 46 of the support base 14 includes left and right side wall portions 96 and 98, respectfully, laterally spaced apart by a distance to receive (e.g., snuggly receive) the middle portion 36 of the fin base portion 30 therebetween and provide lateral support to the fin base portion 30 to assist in preventing lateral movement/rotation of the fin base, and hence the fin portion 28, during use of the watersport board 16. The middle portion 36 of the fin base portion 30 has an inward edge wall 100 that is spaced outward away from the bottom wall 56A of the channel 56. The left and right side wall portions 96 and 98 project away from the bottom wall 56A of the channel 56, and each has an outward edge wall 102 located farther outward than the inward edge wall 100 of the middle portion 36 so that the left and right side wall portions 96 and 98 overlap with the middle portion 36 of the fin base portion 30 during use of the watersport board 16. The left and right side wall portions 96 and 98 longitudinally extend along the channel 56 with forward ends 96A and 98A, respectively, located rearward of a rearward end 32A of the forward end base portion 32 of the fin base portion 30, and with rearward ends 96B and 98B, respectively, located forward of a forward end 34A of the rearward end base portion 34 of the fin base portion 30.

To facilitate transportation or storage the watersport board 16, the foldable fin 12 can move to a folded position (also referred to as a "folded state") with the fin portion 28 adjacent to the bottom side 18 of the watersport board 16, while remaining securely attached to the support base 14 during folding and when in the folded position. FIGS. 27-33B illustrate the fin assembly 10 in a folded state, with the foldable fin 12 positioned fully to the side (e.g., being substantially parallel to the bottom side 18 of the watersport board 16. The design of the foldable fin 12 and the support base 14 eliminates the possibility of losing the fin portion 28 since the support base 14 remains securely attached to the watersport board 16, unlike with designs where the fin is fully disconnected from the watersport board 16 for transport or storage and must be reattached before the next use of the watersport board 16.

The fin assembly 10 provides a mechanism that allows a user to easily folding of the foldable fin 12. The first step includes moving the locking member 24 to a release position as shown in FIGS. 12-15. As shown in FIG. 15, the first step is to rotate the rearward end portion 88 of the locking member 24 counterclockwise, as viewed in FIG. 15 and indicated by arrow "A", to move the forward end portion 90 of the locking member 24 toward the support base 14 sufficiently to disengage the forward end portion 90 from the rearward end face 94 of the rearward pivot member 40 and thereby withdraw the forward end 90A of the forward end portion 90 from within the groove 92 of the rearward end face 94 of the rearward pivot member 40.

Figure 19:
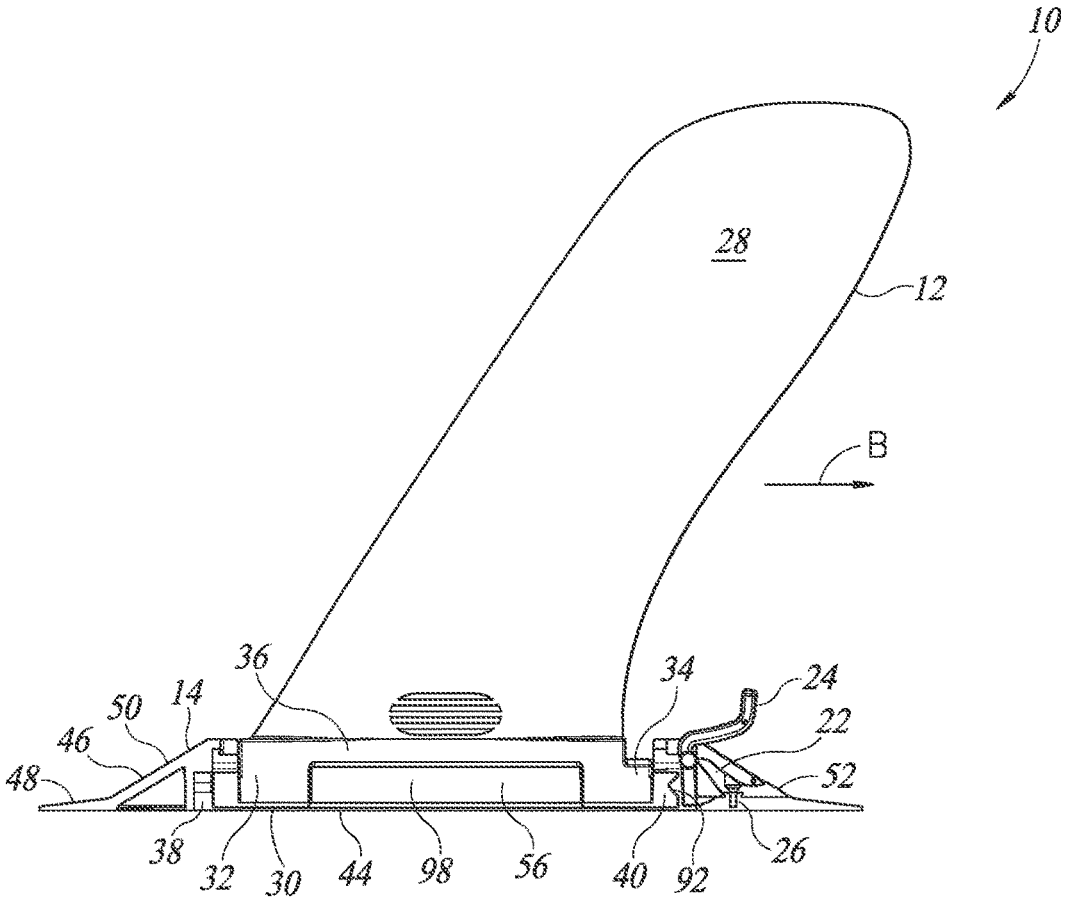
FIG. 19 is a side elevational, partial cross-sectional view of the fin assembly of FIG. 16.
Figure 20:
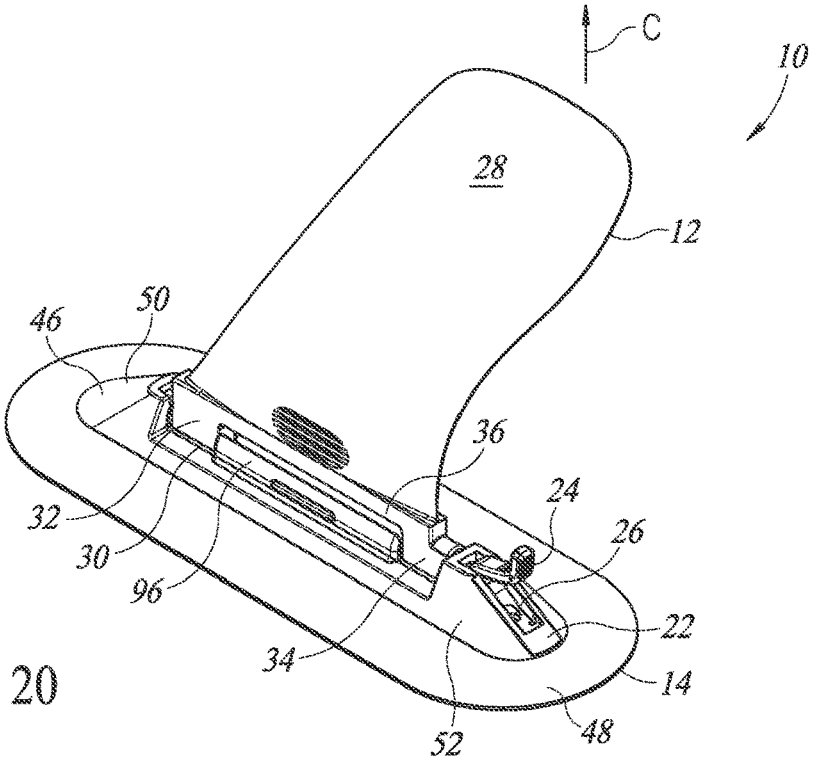
FIG. 20 is a side perspective view of the fin assembly of FIG. 16 with the foldable fin moved in a direction "C" relative to the support base in accordance with embodiments of the present technology.
Figure 21:
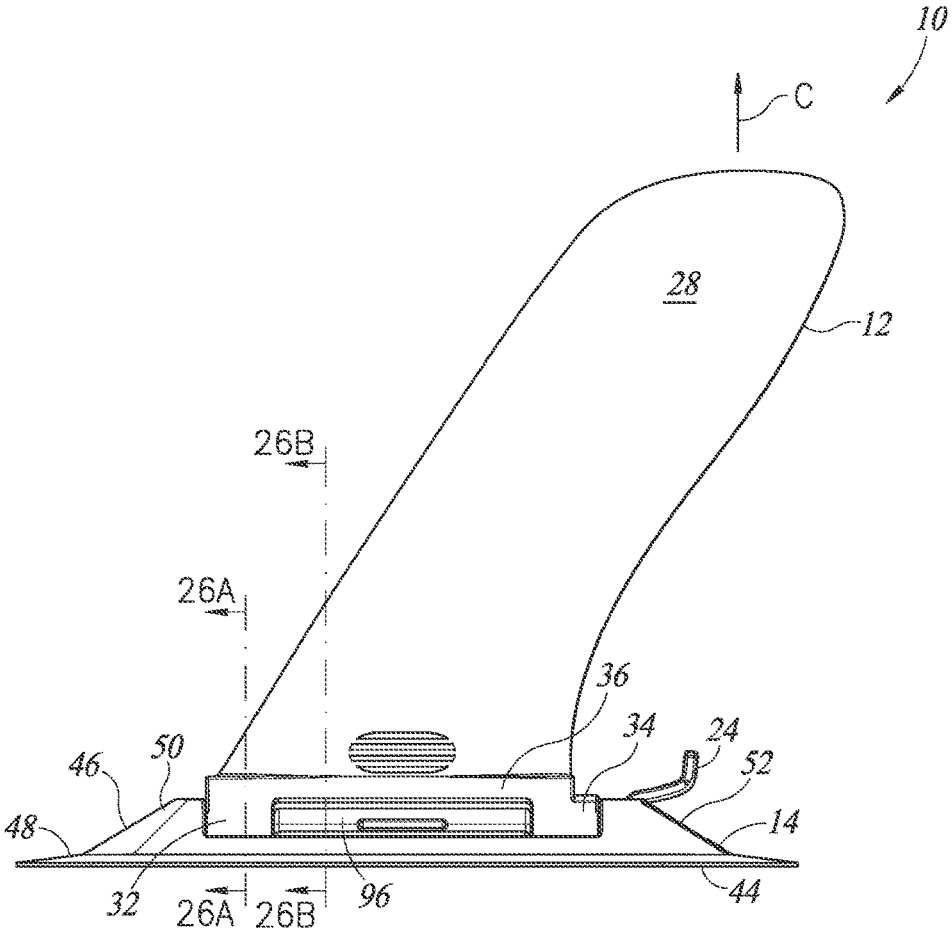
FIG. 21 is a side elevational view of the fin assembly of FIG. 20.
Figure 22:
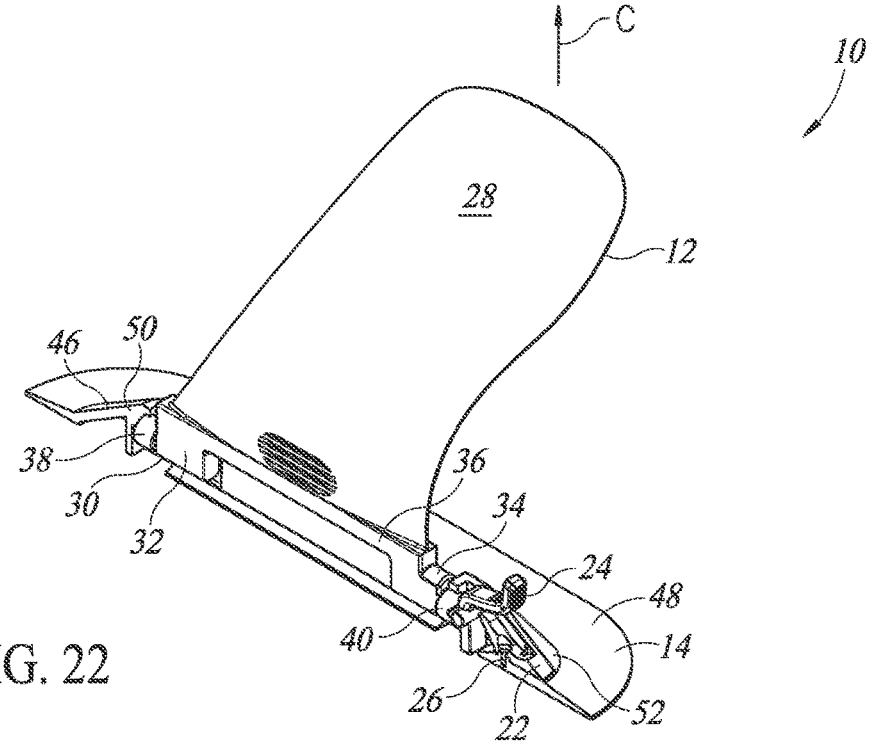
FIG. 22 is a perspective, partial cross-sectional view of the fin assembly of FIG. 20.

The second step includes moving the foldable fin 12 in a first longitudinally relative to the support base 14 as shown in FIGS. 16-19. The first direction is illustrated by arrow "B" in FIG. 19. This includes moving (e.g., sliding) the fin base portion 30 rearward within the channel 56 as indicated by arrow "B" until the forward pivot member 38 is fully withdrawn from within the outward recess portion 64B of the forward recess 64. As is shown in FIG. 19, upon rearward movement of the fin base portion 30 sufficient to fully withdraw the forward pivot member 38 from within the outward recess portion 64B, the rearward end face 94 of the rearward pivot member 40 will engage the forward end portion 90 of the locking member 24 which acts as a stop and prevents further rearward movement of the fin base portion 30. When so rearwardly moved the forward pivot member 38 is fully withdrawn from within the outward recess portion 64B but remains within the inward recess portion 64A of the forward recess 64 which has a wall portion 69 (see FIG. 10A) limiting the extent of its movement away from the bottom wall 56A of the channel 56. The rearward movement of the fin base portion 30 leaves the rearward pivot member 40 within the rearward recess 68, with a wall portion 71 of the forward facing wall 70 (see FIGS. 10B and 10C) limiting the extent of its movement of the rearward pivot member 40 away from the bottom wall 56A of the channel 56. The rearward movement does not result in disconnection of the fin base portion 30 from the support base 14.

Figure 23:
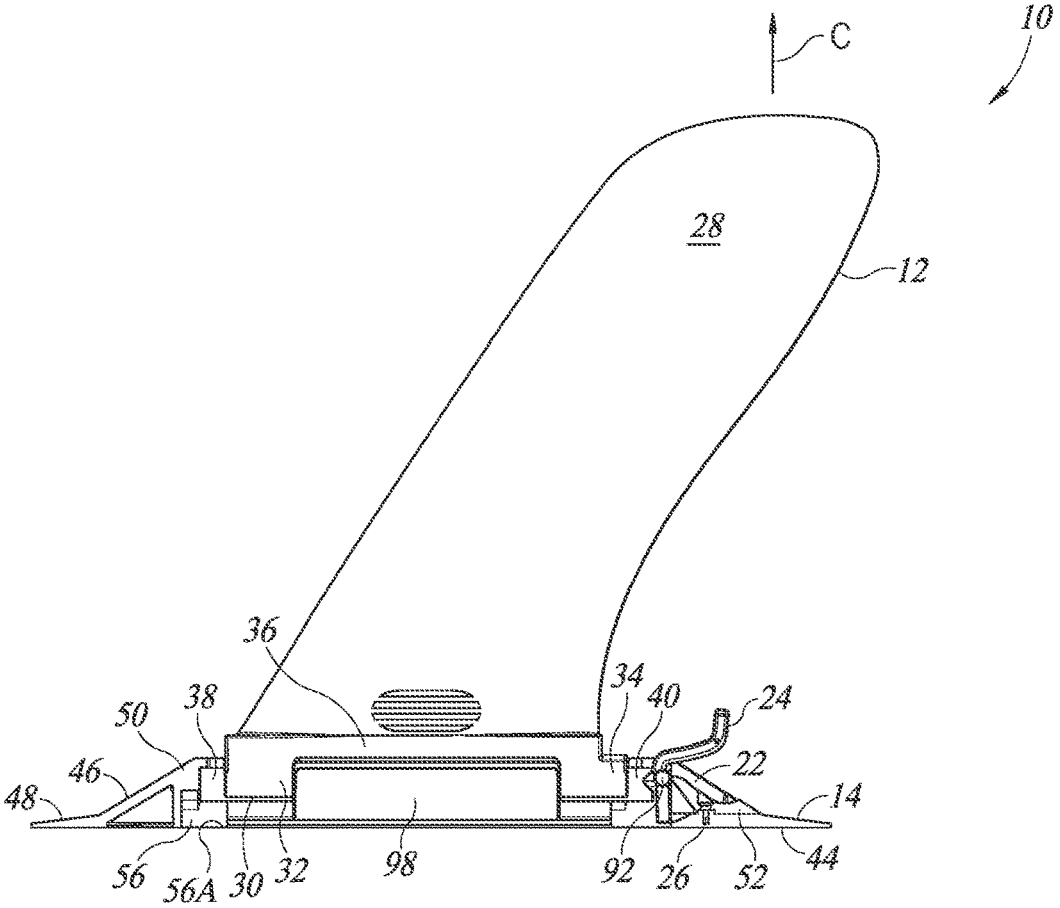
FIG. 23 is a side elevational, partial cross-sectional view of the fin assembly of FIG. 20.
Figure 24:
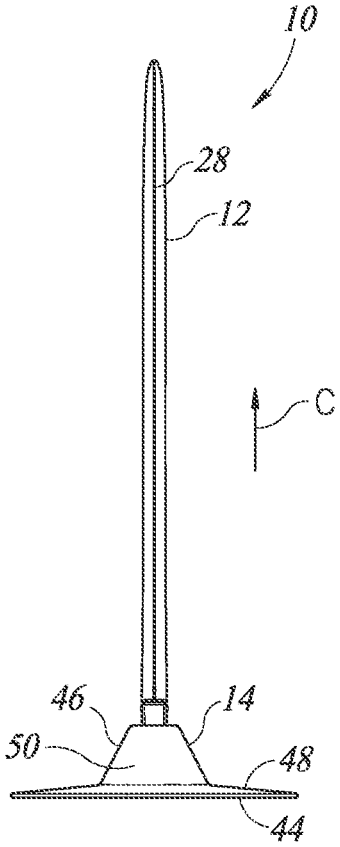
FIG. 24 is a front elevational view of the fin assembly of FIG. 20.
Figure 25:
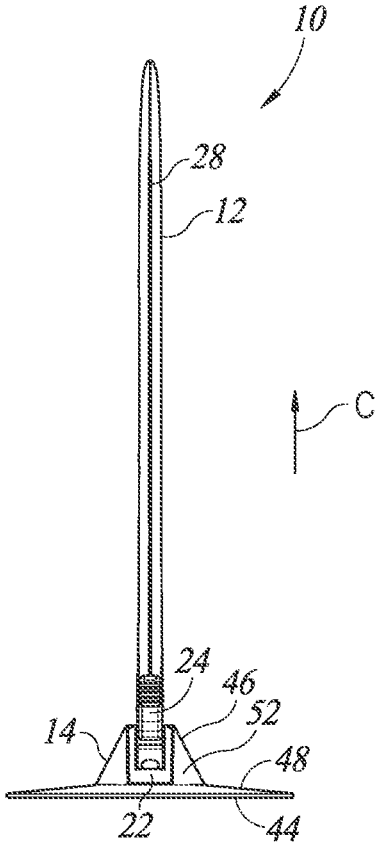
FIG. 25 is a rear elevational view of the fin assembly of FIG. 20.

The third step includes moving the foldable fin 12 away from the support base 14 along a second direction of the support base 14 as shown in FIGS. 20-26B. The second direction as illustrated by arrow "C" in FIG. 23 is different from the first direction as illustrated by arrow "B" in FIG. 19. Referring to FIG. 23, the third step is to move the fin base portion 30 in a direction away from the bottom wall 56A of the channel 56 (i.e., upward as viewed in FIG. 23 and as indicated by arrow "C"), until the inward edge wall 100 of the middle portion 36 of the fin base portion 30 is positioned farther away from the bottom wall 56A of the channel 56 than the outward edge walls 102 of the left and right side wall portions 96 and 98, or at least farther away than the one of the left and right side wall portions 96 and 98 on the side of the outward projecting portion 46 of the support base 14 to which the user wishes to fold the foldable fin 12. The inward edge wall 100 of the middle portion 36 should be positioned away from the outward edge wall 102 sufficient to prevent the side wall portions 96 and 98 from interfering with folding over the foldable fin 12.

Figure 26A:
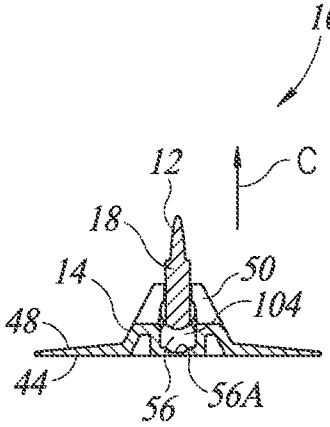
FIG. 26A is a cross-sectional view taken substantially along the line 26A-26A of FIG. 20.
Figure 26B:
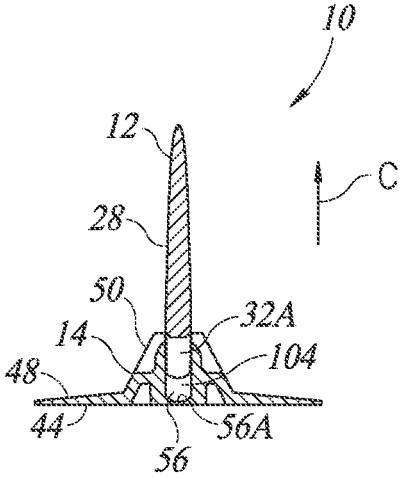
FIG. 26B is a cross-sectional view taken substantially along the line 26B-26B of FIG. 20.
Figure 27:
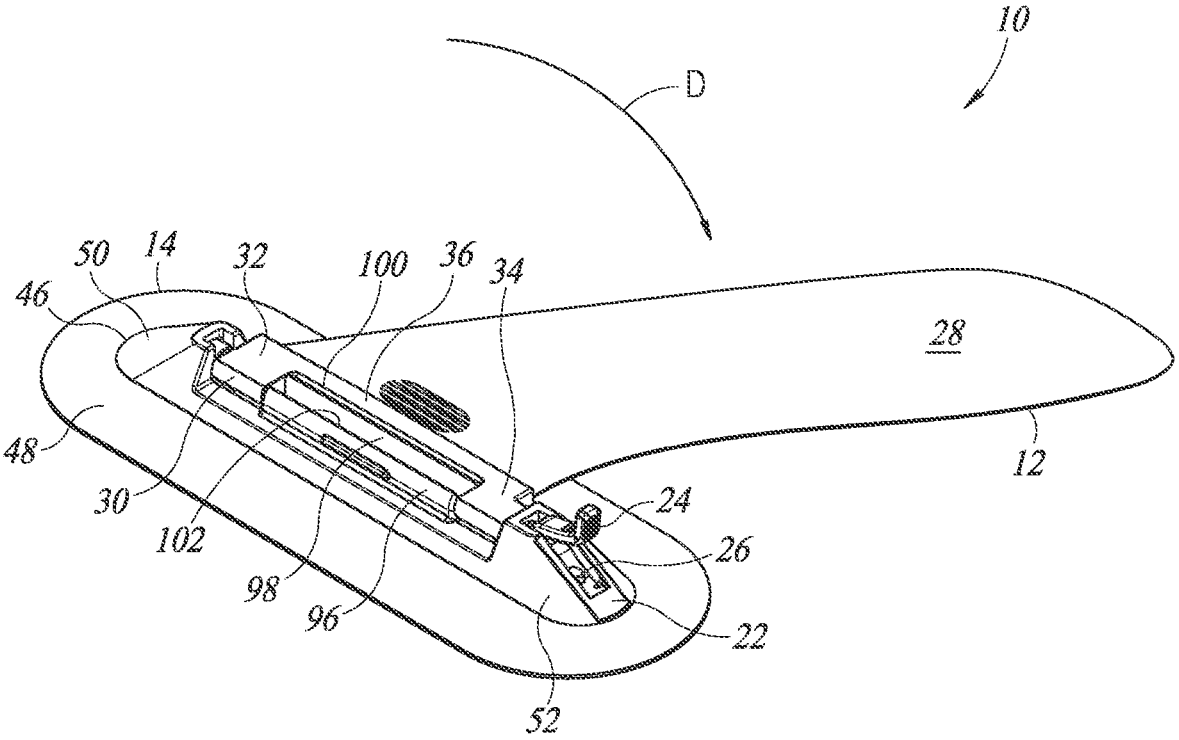
FIG. 27 is a side perspective view of the fin assembly of FIG. 20 with the foldable fin folded in a direction "D" relative to the support base in accordance with embodiments of the present technology.
Figure 28:
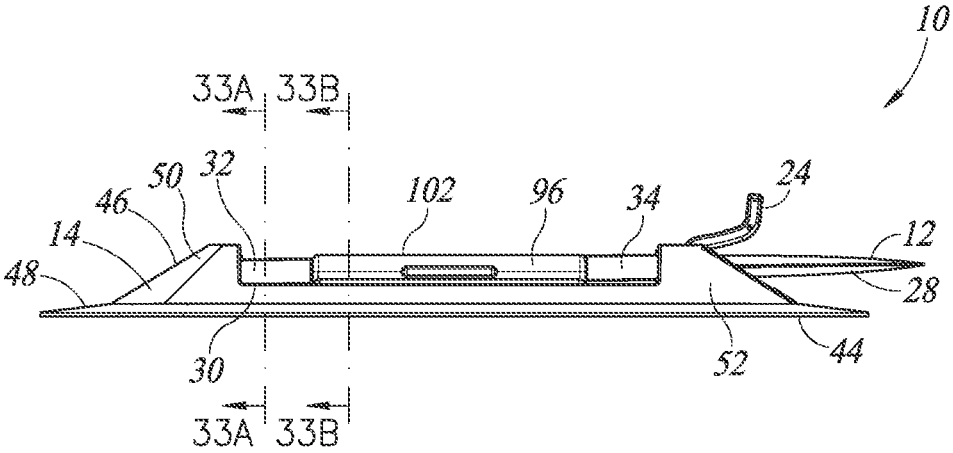
FIG. 28 is a side elevational view of the fin assembly of FIG. 27.
Figure 29A:
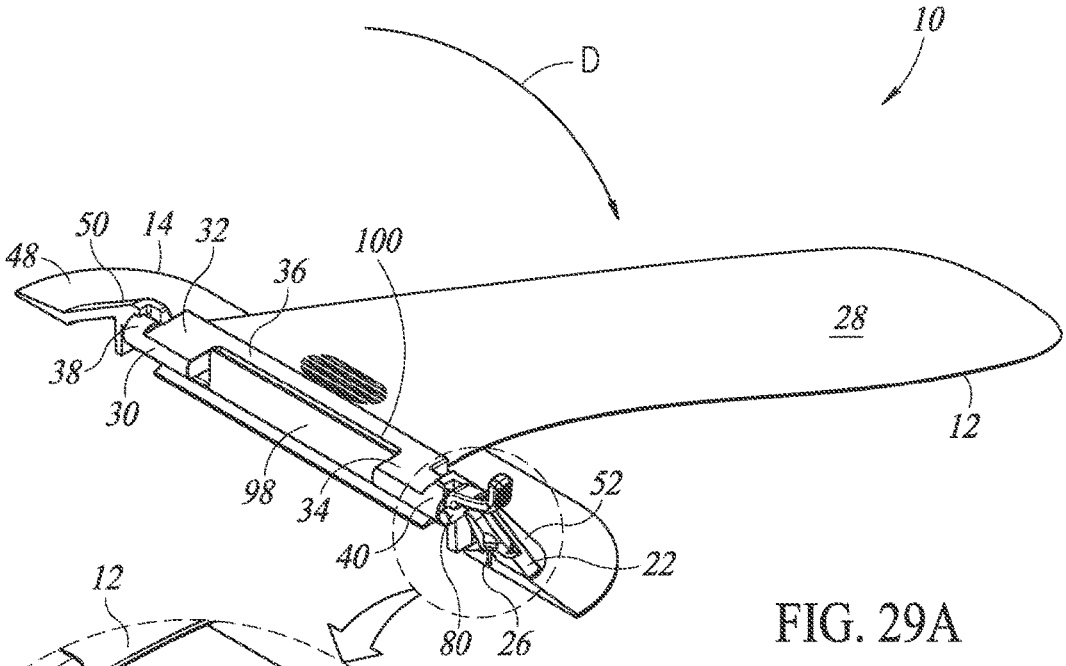
FIG. 29A is a side perspective, partial cross-sectional view of the fin assembly of FIG. 27.
Figure 29B:
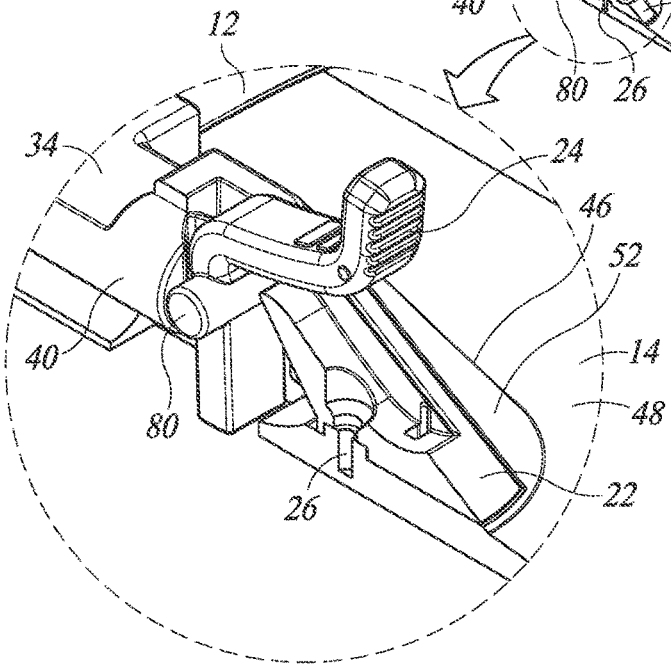
FIG. 29B is an enlarged view of the circled portion of the fin assembly of FIG. 29A.

In this position, the forward pivot member 38 is fully withdrawn from within the outward recess portion 64B but still remains within the inward recess portion 64A of the forward recess 64 with its wall portion 69 limiting the extent of its movement away from the bottom wall 56A of the channel 56, and the rearward pivot member 40 is still within the rearward recess 68 with the wall portion 71 of the forward facing wall 70 limiting the extent of its movement of the rearward pivot member 40 away from the bottom wall 56A of the channel 56. However, in this position the fin base portion 30 is rotatably retained by the support base 14, but the movement does not result in disconnection of the fin base portion 30 from the support base 14. As shown in FIGS. 26A and 26B, the movement in the direction of arrow "C" results in forming a gap 104 between the bottom wall 56A of the channel 56 and the forward end base portion 32 of the fin base portion 30. A similar gap is formed between the bottom wall 56A of the channel 56 and the rearward end base portion 34 of the fin base portion 30.

Figure 30:
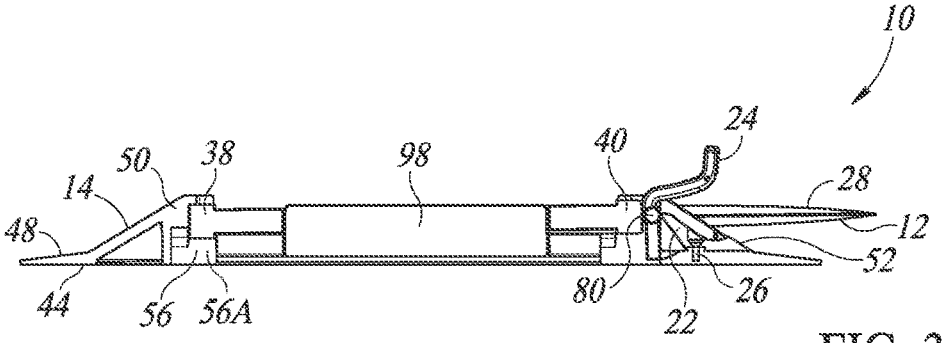
FIG. 30 is a side elevational, cross-sectional view of the fin assembly of FIG. 27.
Figure 31:
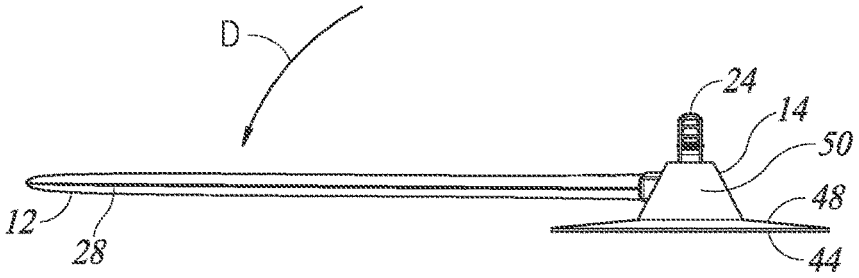
FIG. 31 is a front elevational view of the fin assembly of FIG. 27.
Figure 32:
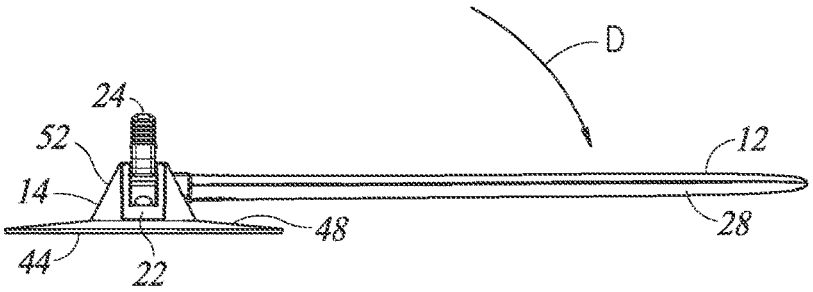
FIG. 32 is a rear elevational view of the fin assembly of FIG. 27.
Figure 33A:
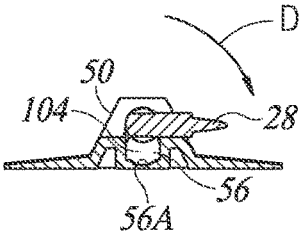
FIG. 33A is a cross-sectional view taken substantially along the line 33A-33A of FIG. 28.
Figure 33B:
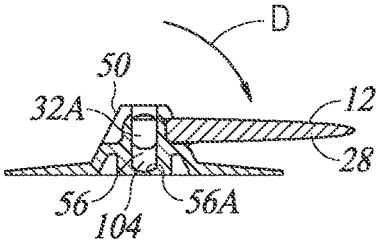
FIG. 33B is a cross-sectional view taken substantially along the line 33B-33B of FIG. 28.

The fourth step includes rotating the foldable fin 12 along a rotation axis to place the fin portion 28 in a folded position as shown in FIGS. 27-33B. The rotation axis is illustrated as a central axis of rotation 42 in FIG. 2. Referring to FIGS. 29A and 30, the fourth step is to rotate the foldable fin 12 clockwise or counterclockwise about the central axis of rotation 42 of the forward and rearward pivot members 38 and 40, to place the foldable fin 12 into the folded position with the fin portion 28 adjacent to the bottom side 18 of the watersport board 16 when the fin assembly 10 is attached to the watersport board 16. Snap features (not shown) are included to releasably retain the foldable fin 12 in the folded position. In the illustrated embodiment, the foldable fin 12 may be folded to the left past the outward edge wall 102 of the left side wall portion 96 or folded to the right past the outward edge wall 102 of the right side wall portion 98. Folding to the right side is illustrated in the drawings, as indicated by arrow "D". To facilitate the folding, the inward edge wall 100 of the middle portion 36 can be positioned sufficiently away from the outward edge wall 102 by the third step so that, during the rotation of the foldable fin 12 in the fourth step, there is sufficient clearance to prevent the side wall portion 96 or 98 from interfering with the folding of the foldable fin 12.

The outward recess portion 64B is sized and the wall portion 69 thereof is positioned to permit at least the limited amount of movement of the forward pivot member 38 in the direction away from the bottom wall 56A sufficient to provide the needed clearance between the inward edge wall 100 and the outward edge wall 102 to permit the folding action. Further, the device is sized and shaped to still prevent the forward pivot member 38 from being fully removed from the outward recess portion 64B and disconnected from the support base 14 during the folding step or when the foldable fin 12 is fully folded. Similarly, the rearward recess 68 is sized and the wall portion 71 of the forward facing wall 70 is positioned to permit at least the limited amount of movement of the rearward pivot member 40 in the direction away from the bottom wall 56A sufficient to provide the needed clearance between the inward edge wall 100 and the outward edge wall 102 to permit the folding action, but still prevent the rearward pivot member 40 from being fully removed from the rearward recess 68 and disconnected from the support base 14 during the folding step or when the foldable fin 12 is fully folded.

To move the fin portion 28 from its folded position to its use position, the four steps described above are essentially taken in reverse. The first step includes rotating the foldable fin 12 along the rotation axis. The foldable fin 12 is rotated about the central axis of rotation 42 of the forward and rearward pivot members 38 and 40 sufficiently to place the foldable fin 12 into an upright position. The second step includes moving the foldable fin 12 toward the support base 14. The fin base portion 30 is moved in a direction toward the bottom wall 56A of the channel 56 (i.e., downward as viewed in the drawings and opposite to the direction as illustrated by arrow "C" in FIG. 23), to position the fin base portion 30 within the channel 56. Next, the third step includes moving the foldable fin 12 longitudinally relative to the support base 14 to place the fin portion 28 in the use position. The fin base portion 30 is moved forward within the channel 56 (e.g., along a direction opposite to the direction as illustrated by arrow "B" in FIG. 19) until the forward pivot member 38 is in engagement with the forward wall 64C of the outward recess portion 64B to limit forward movement of the forward pivot member 38 within the forward channel portion 58 during use of the watersport board 16. Finally, the fourth step includes locking the fin portion 28 in the use position by rotating the locking member 24 to a locked position. The rearward end portion 88 of the locking member 24 is rotated clockwise as viewed in the drawings (e.g., opposite to a direction indicated by arrow "A" in FIG. 15) to move the forward end portion 90 of the locking member 24 away the support base 14 and position its forward end 90A within the groove 92 of the rearward end face 94 of the rearward pivot member 40 such that the locking member 24 is in a locked position. The fin portion 28 is thereby locked by the locking member 24 in the use position and ready for use to aid steering and stability of the watersport board 16 when ridden by a user.

Should it become desirable to remove the foldable fin 12 from the support base 14 for cleaning, repair or replacement, the user need only remove the fastener 26 that holds the retainer member 22 in position within the rearward recess 68 of the rearward channel portion 60 and remove the retainer member 22 and the locking member 24 pivotally attached thereto. With the retainer member 22 and locking member 24 removed, the forward end portion 90 of the locking member 24 no longer inhibits rearward movement of the rearward pivot member 40, and the rearward pivot member 40 may be moved sufficiently rearward to move the forward pivot member 38 sufficiently rearward to fully withdraw the forward pivot member 38 from within both the outward recess portion 64B and the inward recess portion 64A of the forward recess 64. Once so withdrawn, the inward recess portion 64A no longer limits the extent of movement of the forward pivot member 38 away from the bottom wall 56A of the channel 56 and the foldable fin 12 can be disconnected from the support base 14. To reinstall the foldable fin 12, or a replacement foldable fin, the above-described process is repeated in reverse. While the foldable fin 12 may be remove from the support base 14 as described, during normal use, transportation and storage, the foldable fin 12 stays attached to the support base 14, and hence to the watersport board 16, whether in the use position or the folded position.

The foldable fin 12 may be made of a glass filled nylon, or any polymer, composite material, metal, foam, and/or wood, and can be rigid, have a high tensile strength, and/or be impact resistant. The support base 14 may be made of acrylonitrile butadiene styrene (ABS), any polymer or composite material, and/or from a material that is weldable and/or impact resistant. The locking member 24 may be made of an injected polymer, composite material, and/or metal.

EXAMPLES

The following examples are illustrative of several embodiments of the present technology.

1. A fin assembly for a watersport board, comprising:
   a support base having a locking member, the support base being configured to attach the fin assembly to a surface of the watersport board, and
   a foldable fin comprising a fin base portion coupled to the support base and a fin portion extending from the fin base portion, wherein:
   the fin portion is configured to move between a folded position and a use position, and
   the locking member is configured to lock the fin portion in and release the fin portion from the use position.
2. The fin assembly of any one of the embodiments herein wherein:
   the support base comprises a channel extending along a longitudinal axis of the support base; and
   the channel receives at least a portion of the fin base portion so as to movably couple the fin base portion to the support base.
3. The fin assembly of any one of the embodiments wherein:
   the channel comprises a first channel portion and a second channel portion; and
   the fin base portion comprises a first pivot member positioned in the first channel portion and a second pivot member positioned in the second channel portion.
4. The fin assembly of any one of the embodiments wherein the first pivot member and the second pivot member are spaced apart from each other on opposing end portions of the fin base portion.
5. The fin assembly of any one of the embodiments wherein the first channel portion comprises a recess portion configured to receive and limit movement of the first pivot member when the fin portion is in the use position.
6. The fin assembly of any one of the embodiments wherein the locking member is configured to engage with the second pivot member so as to lock the fin portion in the use position.
7. The fin assembly of any one of the embodiments wherein:
   the second pivot member comprises a groove; and
   the locking member is configured to be positioned within the groove to limit movement of the second pivot member.
8. The fin assembly of any one of the embodiments wherein:
   the first channel portion comprises a first wall portion configured to limit movement of the first pivot member away from the support base,
   the second channel portion comprises a second wall portion configured to limit movement of the second pivot member away from the support base, and
   the fin base portion remains attached to the support base by the first wall portion and the second wall portion when the foldable fin is in the folded position.
9. The fin assembly of any one of the embodiments wherein the support base comprises:
   a mounting side portion configured to be mounted on the surface of the watersport board; and
   an outward projecting portion extending along the longitudinal axis of the support base and projecting away from the mounting side portion of the support base.
10. The fin assembly of any one of the embodiments wherein:
   the outward projecting portion comprises the channel, and
   the channel has an opening facing outward away from the mounting side portion of the support base.
11. The fin assembly of any one of the embodiments wherein the outward projecting portion comprises a first wall and a second wall laterally spaced apart from each other by a distance to receive a middle portion of the fin base portion therebetween and provide lateral support to the fin base portion when the fin portion is in the use position.
12. The fin assembly of any one of the embodiments, wherein the support base has a recess, and the fin assembly further comprises:
   a retainer member received in the recess and configured to attach the locking member to the support base; and
   a fastener configured to removably hold the retainer member to the support base.
13. A watersport system comprising:
   watersport equipment having a surface; and
   a fin assembly mounted to the surface of the watersport equipment, the fin assembly comprising—
      a support base having a locking member, the support base being configured to attach the fin assembly to the surface of the watersport equipment, and
      a foldable fin movably coupled to the support base, the foldable fin comprising a fin base portion coupled to the support base and a fin portion extending from the fin base portion, wherein:
         the fin portion is movable between a folded position substantially parallel to the surface of the watersport equipment and a use position substantially perpendicular to the surface, and
         the locking member is configured to lock the fin portion in and release the fin portion from the use position.
14. The watersport system of any one of the embodiments wherein the watersport equipment is a board.
15. The watersport system of any one of the embodiments wherein:

the support base comprises a channel extending along a longitudinal axis of the support base; and the channel receives at least a portion of the fin base portion so as to movably couple the fin base portion to the support base.

16. The watersport system of any one of the embodiments wherein:

the channel comprises a first channel portion and a second channel portion; and the fin base portion comprises a first pivot member positioned in the first channel portion and a second pivot member positioned in the second channel portion.

17. The watersport system of any one of the embodiments wherein the first channel portion comprises a recess portion configured to receive and limit movement of the first pivot member when the fin portion is in the use position.

18. The watersport system of any one of the embodiments wherein the locking member is configured to engage with the second pivot member so as to lock the fin portion in the use position.

19. The watersport system of any one of the embodiments wherein:

the second pivot member comprises a groove; and the locking member is configured to be positioned within the groove to limit movement of the second pivot member.

20. The watersport system of any one of the embodiments wherein:

the first channel portion comprises a first wall portion configured to limit movement of the first pivot member away from the support base, the second channel portion comprises a second wall portion configured to limit movement of the second pivot member away from the support base, and the fin base portion remains attached to the support base by the first wall portion and the second wall portion when the foldable fin is in the folded position.

21. The watersport system of any one of the embodiments wherein the support base comprises a first wall and a second wall that extend along the longitudinal axis of the support base and are laterally spaced apart from each other by a distance to receive a middle portion of the fin base portion therebetween and provide lateral support to the fin base portion when the fin portion is in the use position.

22. A method of using a fin assembly on watersport equipment, the method comprising:

moving a locking member to a release position;

moving a foldable fin in a first direction longitudinally relative to a support base;

moving the foldable fin away from the support base along a second direction of the support base that is different from the first direction; and rotating the foldable fin along a rotation axis to place a fin portion of the foldable fin in a folded position.

23. The method of any one of the embodiments, further comprising:

maintaining attachment of a fin base portion of the foldable fin to the support base when the foldable fin is in the folded position.

24. The method of any one of the embodiments wherein the second direction is substantially perpendicular to the first direction.

25. The method of any one of the embodiments wherein the second direction of the support base is substantially perpendicular to a surface of the watersport equipment to which the fin assembly is attached.

26. The method of any one of the embodiments, further comprising:

removing a fastener that is configured to hold a retainer member in position so as to attach the locking member to the support base;

removing the retainer member;

removing the locking member; and removing the foldable fin from the support base.

27. The method of any one of the embodiments, further comprising:

rotating the foldable fin along the rotation axis;

moving the foldable fin toward the support base, moving the foldable fin longitudinally relative to the support based to place the fin portion to a use position; and locking the fin portion in the use position by rotating the locking member to a locked position.

28. A fin assembly, comprising:

a support base having a locking member, the support base being configured to fixedly attach the fin assembly to a surface of watersport equipment; and a foldable fin comprising a fin base portion coupled to the support base and a fin portion extending from the fin base portion, wherein:

the fin portion is configured to move between a folded position and a use position, and the locking member is configured to lock the fin portion in and release the fin portion from the use position.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present technology have been shown and described, it will be obvious to those skilled in the art that, based upon the teachings herein, changes and modifications may be made without departing from this technology and its broader aspects and, therefore, the appended claims are to encompass within their scope all such changes and modifications as are within the true spirit and scope of this technology. Furthermore, it is to be understood that the technology is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to technologies containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

What is claimed is:

1. A fin assembly for a watersport board, comprising:

a support base having a locking member, the support base being configured to attach the fin assembly to a surface of the watersport board, and a foldable fin comprising a fin base portion coupled to the support base and a fin portion extending from the fin base portion, wherein:

the fin portion is configured to move between a folded position and a use position, and the locking member is configured to lock the fin portion in and release the fin portion from the use position.

2. The fin assembly of claim 1 wherein:

the support base comprises a channel extending along a longitudinal axis of the support base; and the channel receives at least a portion of the fin base portion so as to movably couple the fin base portion to the support base.

3. The fin assembly of claim 2 wherein:

the channel comprises a first channel portion and a second channel portion; and the fin base portion comprises a first pivot member positioned in the first channel portion and a second pivot member positioned in the second channel portion.

4. The fin assembly of claim 3 wherein the first pivot member and the second pivot member are spaced apart from each other on opposing end portions of the fin base portion.

5. The fin assembly of claim 3 wherein the first channel portion comprises a recess portion configured to receive and limit movement of the first pivot member when the fin portion is in the use position.

6. The fin assembly of claim 3 wherein the locking member is configured to engage with the second pivot member so as to lock the fin portion in the use position.

7. The fin assembly of claim 6 wherein:

the second pivot member comprises a groove; and the locking member is configured to be positioned within the groove to limit movement of the second pivot member.

8. The fin assembly of claim 3 wherein:

the first channel portion comprises a first wall portion configured to limit movement of the first pivot member away from the support base, the second channel portion comprises a second wall portion configured to limit movement of the second pivot member away from the support base, and the fin base portion remains attached to the support base by the first wall portion and the second wall portion when the foldable fin is in the folded position.

9. The fin assembly of claim 2 wherein the support base comprises:

a mounting side portion configured to be mounted on the surface of the watersport board; and an outward projecting portion extending along the longitudinal axis of the support base and projecting away from the mounting side portion of the support base.

10. The fin assembly of claim 9 wherein:

the outward projecting portion comprises the channel, and the channel has an opening facing outward away from the mounting side portion of the support base.

11. The fin assembly of claim 9 wherein the outward projecting portion comprises a first wall and a second wall laterally spaced apart from each other by a distance to receive a middle portion of the fin base portion therebetween and provide lateral support to the fin base portion when the fin portion is in the use position.

12. The fin assembly of claim 1, wherein the support base has a recess, and the fin assembly further comprises:

a retainer member received in the recess and configured to attach the locking member to the support base; and a fastener configured to removably hold the retainer member to the support base.

13. A watersport system comprising:

watersport equipment having a surface; and a fin assembly mounted to the surface of the watersport equipment, the fin assembly comprising— a support base having a locking member, the support base being configured to attach the fin assembly to the surface of the watersport equipment, and a foldable fin movably coupled to the support base, the foldable fin comprising a fin base portion coupled to the support base and a fin portion extending from the fin base portion, wherein:

the fin portion is movable between a folded position substantially parallel to the surface of the watersport equipment and a use position substantially perpendicular to the surface, and the locking member is configured to lock the fin portion in and release the fin portion from the use position.

14. The watersport system of claim 13 wherein the watersport equipment is a board.

15. A method of using a fin assembly on watersport equipment, the method comprising:

moving a locking member to a release position;

moving a foldable fin in a first direction longitudinally relative to a support base;

moving the foldable fin away from the support base along a second direction of the support base that is different from the first direction; and rotating the foldable fin along a rotation axis to place a fin portion of the foldable fin in a folded position.

16. The method of claim 15, further comprising:

maintaining attachment of a fin base portion of the foldable fin to the support base when the foldable fin is in the folded position.

17. The method of claim 15 wherein the second direction is substantially perpendicular to the first direction.

18. The method of claim 15 wherein the second direction of the support base is substantially perpendicular to a surface of the watersport equipment to which the fin assembly is attached.

19. The method of claim 15, further comprising:

removing a fastener that is configured to hold a retainer member in position so as to attach the locking member to the support base;

removing the retainer member;

removing the locking member; and removing the foldable fin from the support base.

20. The method of claim 15, further comprising:

rotating the foldable fin along the rotation axis;

moving the foldable fin toward the support base, moving the foldable fin longitudinally relative to the support base to place the fin portion to a use position; and locking the fin portion in the use position by rotating the locking member to a locked position.

* * * * *